US010753693B2

(12) United States Patent
Lung et al.

(10) Patent No.: US 10,753,693 B2
(45) Date of Patent: Aug. 25, 2020

(54) AMMUNITION STORAGE SYSTEM

(71) Applicant: Moog Inc., Elma, NY (US)

(72) Inventors: Kevin Lung, Wadsworth, IL (US); Steven W. Hayes, Santa Barbara, CA (US); Matthew Martinez, Bakersfield, CA (US); David Rhodes, Solvang, CA (US); Frank Mueller, Santa Ynez, CA (US)

(73) Assignee: Moog Inc., East Aurora, NY (US)

( * ) Notice: Subject to any disclaimer, the term of this patent is extended or adjusted under 35 U.S.C. 154(b) by 0 days.

(21) Appl. No.: 16/230,679

(22) Filed: Dec. 21, 2018

(65) Prior Publication Data

US 2019/0120580 A1 Apr. 25, 2019

Related U.S. Application Data

(62) Division of application No. 15/520,111, filed as application No. PCT/US2015/056314 on Oct. 20, 2015, now Pat. No. 10,203,175.

(60) Provisional application No. 62/066,729, filed on Oct. 21, 2014.

(51) Int. Cl.
*F41A 9/30* (2006.01)
*F41A 9/86* (2006.01)

(52) U.S. Cl.
CPC . *F41A 9/30* (2013.01); *F41A 9/86* (2013.01)

(58) Field of Classification Search
CPC ..... F41A 9/30; F41A 9/86
USPC ..... 89/33.16, 33.25
See application file for complete search history.

(56) References Cited

U.S. PATENT DOCUMENTS 2,386,894 A * 10/1945 Hartley ..... F41A 9/86 89/33.16
2,390,477 A * 12/1945 Trotter ..... F41A 9/51 89/33.5
2,436,404 A * 2/1948 Slate ..... F41A 9/51 89/33.5
2,437,425 A 3/1948 Goodhue et al.
(Continued)

FOREIGN PATENT DOCUMENTS

CA 2963710 A1 * 4/2016 ..... F41A 9/30
JP H04309797 A 11/1992

OTHER PUBLICATIONS

ISA/US, International Search Report for PCT/US2015/056314 dated Feb. 12, 2016.

*Primary Examiner* — Samir Abdosh
(74) *Attorney, Agent, or Firm* — Hogdson Russ LLP

(57) ABSTRACT

Ammunition containers are reloadable from within an armored vehicle to supply a remote weapon system mounted externally on the vehicle. The ammunition containers are designed to be fixedly mounted within an internal compartment of a weapon turret. In a first embodiment, at least one guide wall defines a spiral guide path for an ammunition belt, and a rotatable sprocket enables the belt to be loaded into the guide path. In a second embodiment, an ammunition clamp holds a round of ammunition, and the clamp is rotatable to wind the ammunition belt about the clamp's axis of rotation. A third embodiment has a guide sprocket and an adjacent peg to facilitate reloading an ammunition belt in horizontal layers. A fourth embodiment includes a pair of spaced support rails for hanging an ammunition belt in vertical columns, wherein rear ends of the rails may be located outside the container for easier loading.

6 Claims, 29 Drawing Sheets

(56) References Cited

U.S. PATENT DOCUMENTS

| | | | | | |
|---|---|---|---|---|---|
| 2,464,689 | A * | 3/1949 | Jackson | B65G 11/103 414/507 |
| 2,470,475 | A | 5/1949 | Diaper | |
| 2,494,564 | A | 1/1950 | Lambert | |
| 2,573,749 | A * | 11/1951 | Wheeler | F41A 9/54 89/33.16 |
| 2,573,774 | A | 11/1951 | Sandberg | |
| 2,833,182 | A | 5/1958 | Houston et al. | |
| 4,318,331 | A * | 3/1982 | Echtler | F41A 9/09 89/34 |
| 4,433,609 | A | 2/1984 | Darnall | |
| 4,658,701 | A * | 4/1987 | Moore | F41A 9/31 89/33.2 |
| 5,111,729 | A | 5/1992 | Tassie et al. | |
| 5,245,908 | A | 9/1993 | Sanderson | |
| 6,164,180 | A * | 12/2000 | Sulm | F41A 9/79 89/33.04 |
| 6,439,098 | B1 | 8/2002 | Dillon | |
| 7,913,610 | B2 | 3/2011 | Ulveraker et al. | |
| 8,607,683 | B1 * | 12/2013 | Burgermeister | F41A 9/31 89/33.16 |
| 8,763,511 | B2 * | 7/2014 | Schvartz | F41A 9/34 89/33.2 |
| 2012/0186423 | A1 | 7/2012 | Chachamian et al. | |
| 2012/0312153 | A1 | 12/2012 | Fowler, IV et al. | |
| 2013/0098231 | A1 | 4/2013 | Tatum | |
| 2018/0299215 | A1 * | 10/2018 | Lung | F41A 9/86 |

* cited by examiner

AMMUNITION STORAGE SYSTEM

FIELD OF THE INVENTION

The present invention relates generally to the field of remote-controlled weapon stations or systems (RWSs) designed to mount over a hatch opening in a top deck of an armored vehicle, and more particularly to ammunition storage systems for storing and supplying linked ammunition to weapons of the externally-mounted RWS from within the armored vehicle.

BACKGROUND OF THE INVENTION

Vehicle-mounted RWSs are retrofittable to various types of military vehicles, including but not limited to armored combat vehicles (ACVs), mine-resistant ambush protected (MRAP) vehicles, armored multi-purpose vehicles (AMPVs), amphibious assault vehicles (AAVs), and light armored vehicles (LAVs). The RWS allows personnel to operate externally-mounted weapons from the within the armored protection of the vehicle.

An RWS may be outfitted with selected weapons (e.g. guns and missile launchers), and non-lethal operating units (e.g. target sighting units, acoustic hailers, and illuminators), to provide desired performance capabilities. Missile launchers suitable for use in an RWS include, without limitation, a Hellfire missile launcher, a Javelin missile launcher, and a TOW missile launcher. Automatic guns that process linked ammunition are favored in RWS configurations. Some of the guns falling into this category are the MK44 chain gun, CTAI 30 mm and 40 mm canons, the M242 chain gun, the M230LF autocannon, the M2 machine gun, the M3 submachine gun, the MK19 automatic grenade launcher, the M240 machine gun, the M249 light machine gun, and the M134 machine gun. Of course, an RWS may be outfitted with weapons and operating units other than those specifically mentioned above.

The linked ammunition typically comes in the form of a long ammunition belt held within an ammunition container. The belt extends out through an exit opening in the container to an ammunition feed mechanism at the gun. As an existing ammunition belt advances and is used up during firing, a leading link of a subsequent ammunition belt may be coupled to a trailing link of the existing belt to accomplish reloading. In some systems, the new belt is loaded into the existing container, while in other systems, the existing emptied container is removed and replaced with a new container holding the new belt.

An ammunition container wherein the ammunition belt is folded in serpentine fashion to provide overlapping horizontal belt segments is known from U.S. Pat. No. 2,470,475 (Diaper). The ammunition container described by Diaper has a plurality of foldable shelves that support the belt segments, and an antifriction roller adjacent an ammunition exit opening of the container.

Another type of ammunition container designed to be reloaded when emptied is a hanging ammunition or suspended ammunition container. In this known arrangement, an ammunition belt is folded in serpentine fashion within the ammunition container, with upper links in the belt being supported by parallel rails at or near the top of the container so as to suspend or hang folded vertical segments of the belt in the container. This type of "hanging ammo" arrangement is described, for example, in U.S. Pat. No. 2,573,774 (Sandberg); U.S. Pat. No. 4,433,609 (Darnall); and U.S. Pat. No. 8,763,511 (Schvartz et al.).

Ammunition storage and feeding systems wherein the ammunition belt is wound in a helical arrangement about a central axis with the individual rounds of ammunition arranged to extend radially relative to the central axis are also known, as evidenced by U.S. Pat. No. 2,833,182 (Houston et al.) and U.S. Pat. No. 5,111,729 (Tassie). The systems taught by Houston et al. and Tassie require a large diameter to accommodate storage of the radial ammunition rounds, with the diameter being dependent upon the overall length of the ammunition round. These systems also require multi-axis motion to load ammunition, namely rotation about the central axis and translation along the central axis, which in turn has led to mechanically complex devices with many moving parts.

In designing an RWS, it is desirable to provide personnel with the capability to reload the externally mounted automatic guns with linked ammunition while the personnel remain within the relatively safe confines of the armored vehicle. U.S. Patent Application Publication No. 2012/0186423 (Chachamian et al.) describes a system for protected reloading of an RWS. The system comprises an extendable and retractable support bracket having a top plate attached to the RWS and a bottom plate for receiving and supporting an ammunition container. The bottom plate is connected to the top plate by four gas pistons enabling the bottom plate carrying the ammunition box to be raised up into the RWS turret for regular use and lowered down into the vehicle compartment for reloading. While the system enables reloading under armored protection, it requires a mechanically complicated bracket and uses space within the vehicle compartment to accommodate the lowered ammunition container during reloading. Given that the vehicle compartment is already very confined, this solution is not optimal.

Another system for under armor reloading of ammunition is described in the aforementioned U.S. Pat. No. 8,763,511 (Schvartz et al). The ammunition containers disclosed by Schvartz et al. are open at the front end and the rear end such that multiple containers may be stowed end-to-end in the RWS with their belts linked for regular use. An elevator mechanism is provided to lift ammunition containers from the vehicle compartment through a hatch and into the RWS. When a rearmost container is emptied, it is removed manually or using the elevator to make room for another container. Here again, the system enables reloading under armored protection, but it requires an elevator mechanism and uses valuable space within the vehicle compartment. The system also dedicates limited space within the RWS pedestal for multiple ammunition cans associated with only a single weapon.

What is needed is an ammunition storage system that has high reliability due to few moving parts, and that enables reloading of ammunition under armored protection without using valuable space within the vehicle compartment and without relying on a conveyor mechanism.

SUMMARY OF THE INVENTION

The invention provides an ammunition container for storing a belt of linked ammunition. The ammunition container is reliable, space efficient, and reloadable entirely above the vehicle roof within the armor protection of the turret.

An ammunition container formed in accordance with a first embodiment of the invention generally comprises a pair of parallel side walls, at least one guide wall connecting the pair of side walls, and a sprocket rotatable about a sprocket axis extending normal to the pair of side walls. The at least one guide wall defines a loading access opening and an exit opening between the side walls, and further defines a guide path for a belt of ammunition, wherein the guide path begins at an origin and extends continuously from the origin to the exit opening. The at least one guide wall may include a spirally wound guide wall defining a generally spiraled guide path. The sprocket may be rotated to urge a belt of ammunition along the guide path in a loading direction from the loading access opening to the origin of the guide path.

An ammunition container formed in accordance with a second embodiment of the invention operates in the manner of a spool. The ammunition container of the second embodiment generally comprises a pair of parallel side walls, an ammunition clamp mounted between the pair of side walls for rotation about a clamp axis extending normal to the pair of side walls, a keeper movable relative to the pair of parallel side walls. The ammunition clamp is configured to clamp a single round of ammunition such that the round extends parallel to the clamp axis, and the ammunition clamp is rotatable about the clamp axis to wind a belt of ammunition about the clamp axis. The keeper is biased to exert force on a portion of a wound ammunition belt in a direction toward the clamp axis to maintain the ammunition belt in a wound condition as the ammunition belt is fed to a weapon. An outfeed roller may be provided to help guide the rounds of the ammunition belt as they exit the container on their way to a weapon.

An ammunition container formed in accordance with a third embodiment of the invention is configured for manual reloading such that the belt of ammunition is guided into the container and may be easily folded over onto itself to form horizontal layers. The ammunition container of the third embodiment comprises a pair of transversely spaced side walls and a bottom wall connecting the pair of side walls. The side walls define an internal space between them, an exit opening at a top front region of the container, and a loading access opening at a top rear of the container. The ammunition container of the third embodiment further comprises sprocket positioned proximate to the loading access opening, and a transversely extending peg fixed relative to the pair of side walls at a location above and behind the sprocket. The sprocket is rotatable about a transverse sprocket axis relative to the pair of side walls to guide rounds of ammunition through the loading access opening and into the internal space. The peg enables a new belt of linked ammunition to be suspended vertically adjacent the sprocket as the belt is being loaded into the container.

An ammunition container formed in accordance with a fourth embodiment of the present invention is an improved version of a hanging ammunition container. The ammunition container of the fourth embodiment comprises a pair of transversely spaced side walls connected by at least one transverse bride member. The pair of side walls define an internal space between them, and also define a rear opening and a bottom opening continuous with the rear opening, wherein the rear and bottom openings allow access to the internal space. The ammunition container further comprises a pair of longitudinal support rails respectively mounted to corresponding inner surfaces of the pair of side walls. Each of the support rails may extend through the rear opening of the container such that a rear end of each support rail is located outside of the internal space for easier loading.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
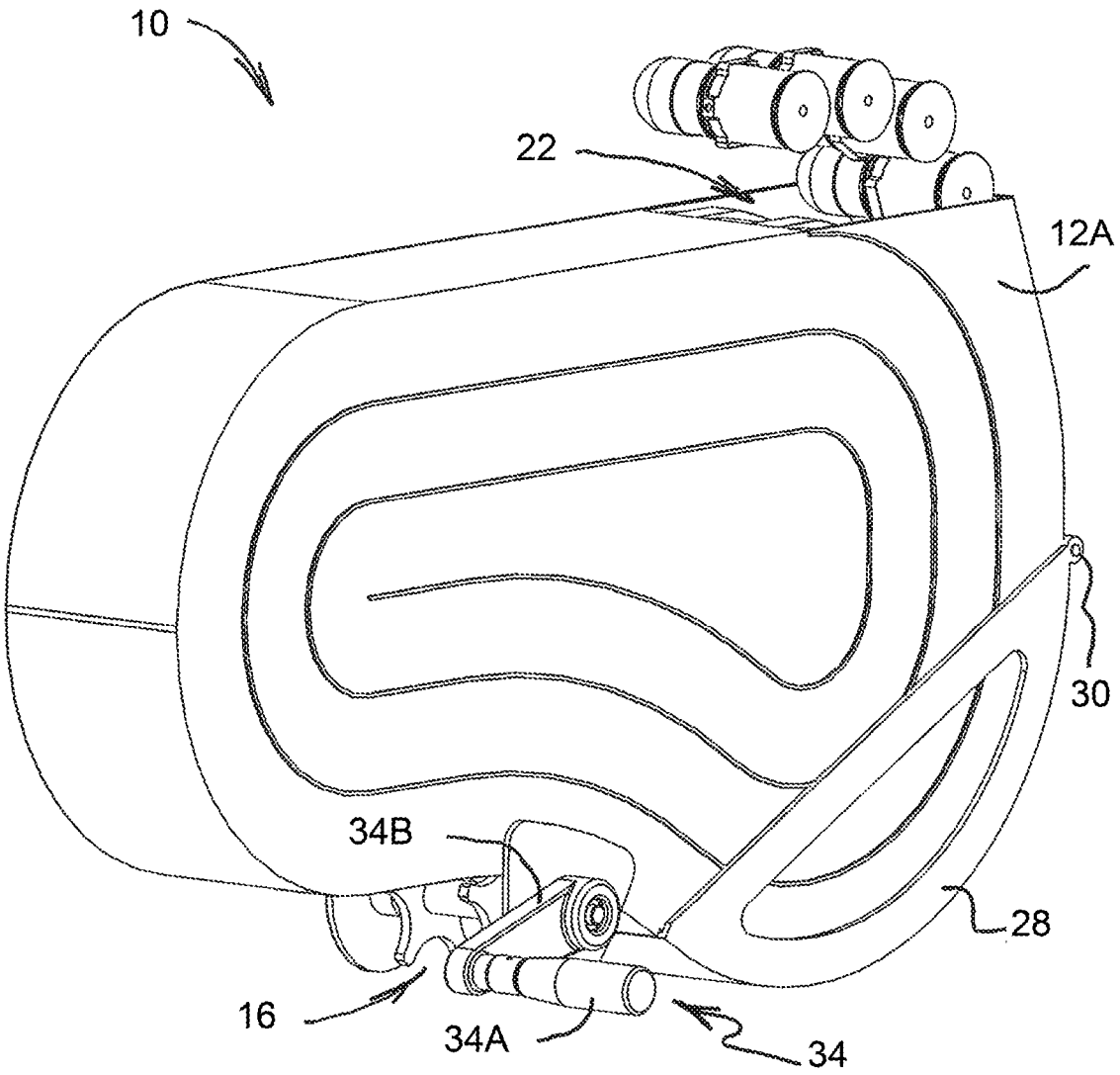
FIG. 1 is a perspective view of an ammunition storage container formed in accordance with a first embodiment of the present invention.

FIGS. 1-4 show an ammunition container 10 formed in accordance with a first embodiment of the present invention. Ammunition container 10 is useful for storing a belt of linked ammunition within an internal compartment of an RWS turret mounted on an armored vehicle, wherein the ammunition belt is fed round-by-round to an external weapon of the RWS. More particularly, ammunition container 10 is configured to be safely reloaded by personnel inside the armored vehicle without disconnecting or removing rounds between an exit opening of the container and the weapon, and provides space-efficient storage of ammunition in a confined environment.

Ammunition container 10 of the first embodiment generally comprises a pair of parallel side walls 12A, 12B, at least one guide wall 14A, 14B connecting the pair of side walls, and a sprocket 16 rotatable about a sprocket axis 18 extending normal to the pair of side walls. As may be understood from FIG. 3, the at least one guide wall 14A, 14B defines a loading access opening 20 between the pair of side walls 12A, 12B, and also defines an exit opening 22 between the pair of side walls. It is further apparent from FIG. 3 that the at least one guide wall 14A, 14B defines a guide path 24 for a belt of ammunition, wherein the guide path begins at an origin 26 and extends continuously from the origin to the exit opening 22.

In the depicted embodiment, ammunition container 10 further comprises an access cover 28 removably covering the loading access opening 20. Access cover 28 may be mounted on ammunition container 10 by a hinge 30 allowing access cover 28 to pivot about a hinge axis that is parallel to sprocket axis 18 in the manner of a door. While a hinged access cover is shown, it will be understood that a sliding access cover or an access cover that snaps on and off are possible alternatives. Access cover 28 may provide another guide wall 14C complementing guide walls 14A, 14B when access cover 28 is covering the loading access opening 20.

Figure 3:
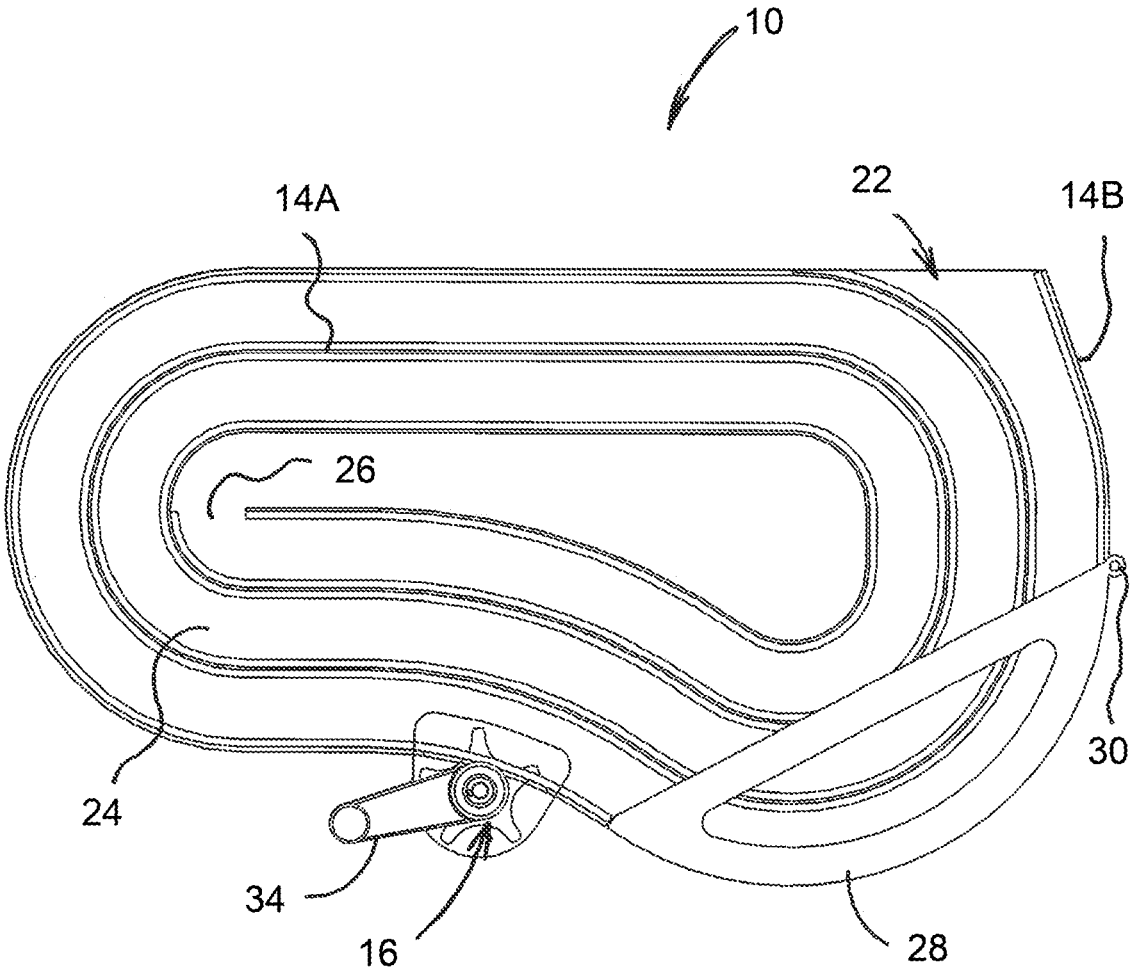
FIG. 3 is a schematic side view of the ammunition storage container shown in FIG. 1 illustrating an internal ammunition guide path of the container.
Figure 4:
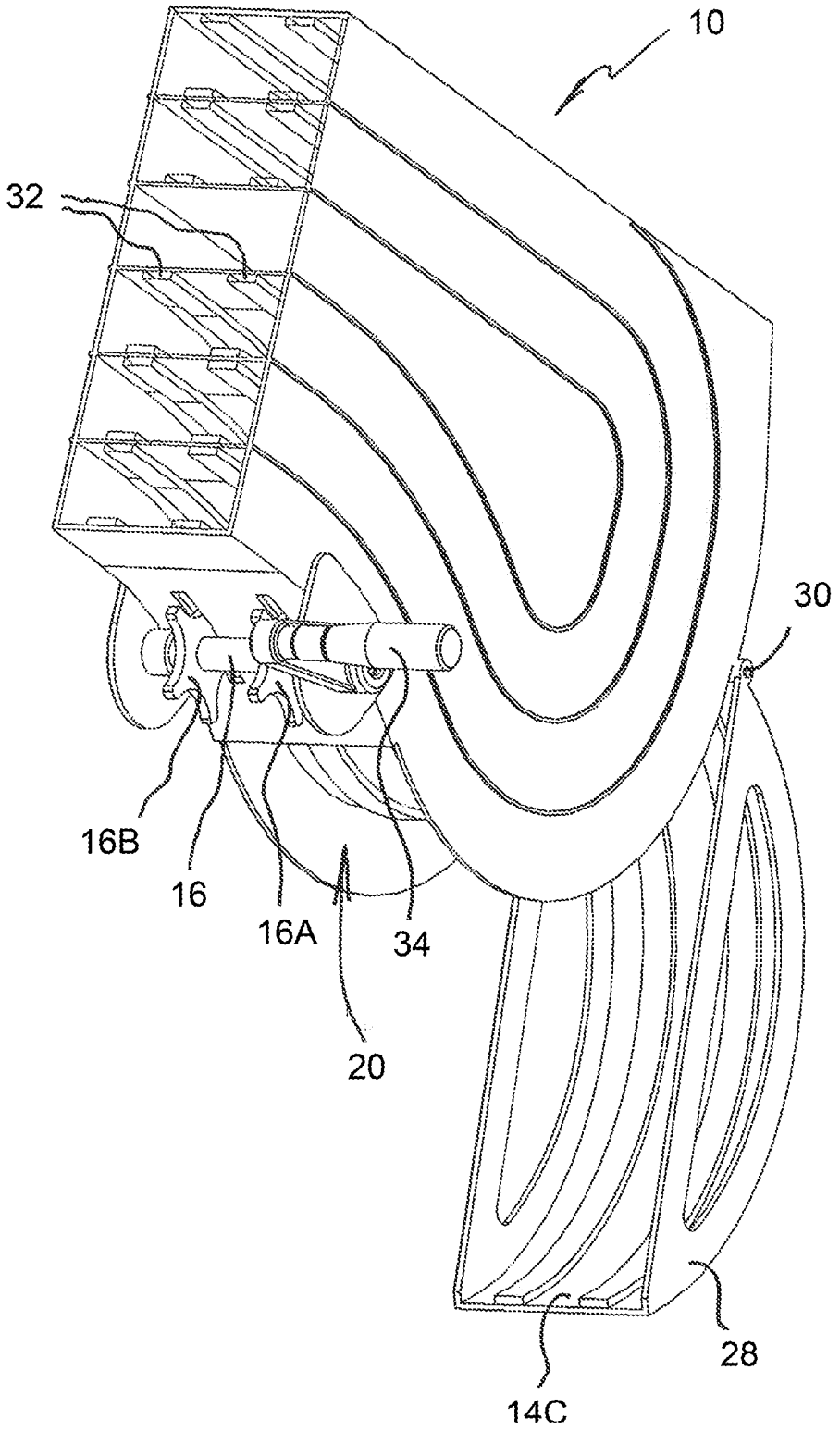
FIG. 4 is another perspective view of the ammunition storage container shown in FIG. 1, sectioned to show internal structure of the ammunition container.

As best understood from FIG. 3, guide wall 14A of the present embodiment may be spirally wound in a spaced manner to help define guide path 24. Guide walls 14A-14C may include a pair of spaced support tracks 32, visible in FIG. 4, for engaging rounds of ammunition in an ammunition belt. Tracks 32 may be formed of or coated with a material that exhibits high wear resistance and/or low friction, for example polytetrafluoroethylene (PTFE) or an aluminum-nickel-bronze alloy.

Figure 2:
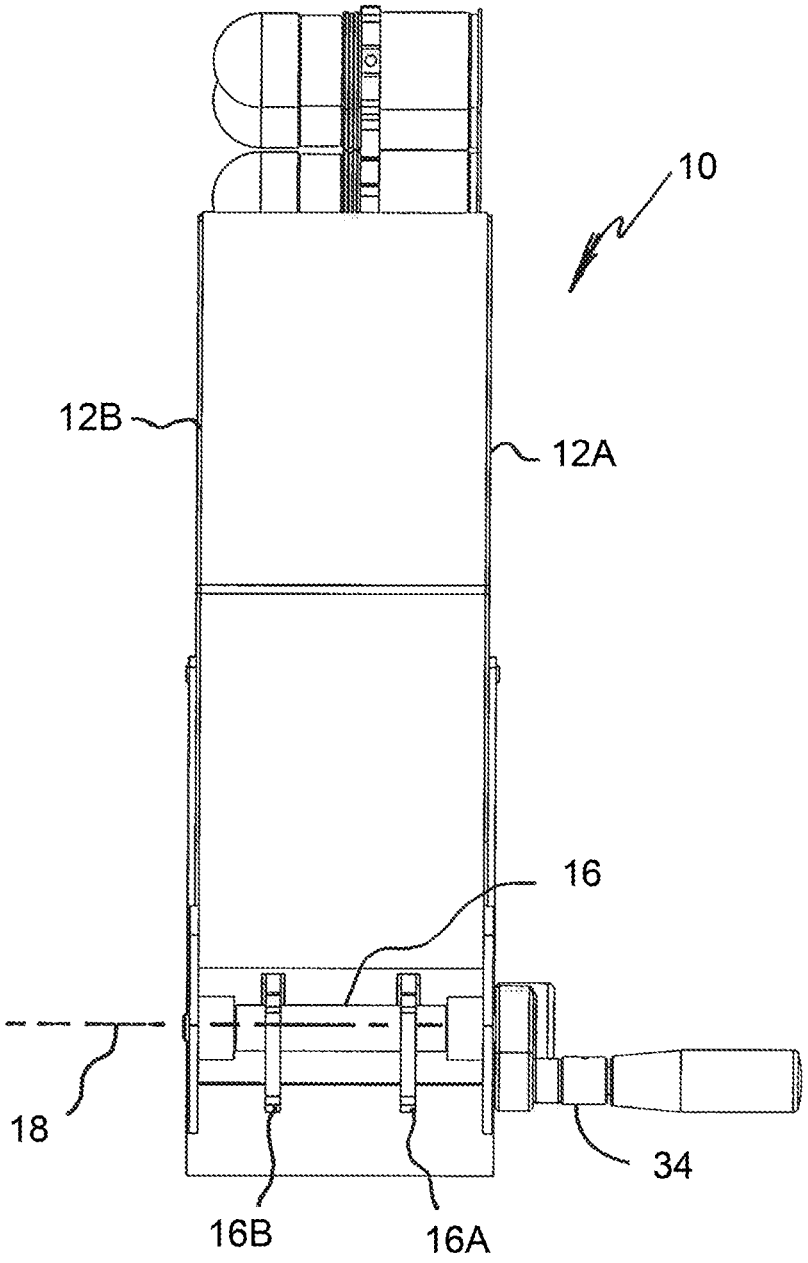
FIG. 2 is an end view of the ammunition storage container shown in FIG. 1.

Sprocket 16 may be positioned proximate to loading access opening 20. As seen in FIG. 2, sprocket 16 may include a pair of toothed sprocket elements 16A, 16B spaced apart along sprocket axis 18, wherein the teeth of the sprocket elements have a pitch chosen to allow one round of ammunition between adjacent teeth. Ammunition container 10 may comprise a hand-crank 34 connected to sprocket 16 for allowing a user to manually rotate sprocket 16 about sprocket axis 18. Hand-crank 34 may be connected to sprocket 16 by a ratchet mechanism (not shown) for enabling rotation of sprocket 16 in a first rotational direction, e.g. counterclockwise in FIG. 3, while preventing rotation of the sprocket in a second rotational direction opposite to the first rotational direction, e.g. clockwise in FIG. 3. As will be understood from description that follows, a ratchet mechanism is beneficial to prevent a belt of ammunition from sliding out of ammunition container 10 during loading. The connection between hand-crank 34 and sprocket 16 may be releasable to prevent the hand-crank from rotating with sprocket 16 when an ammunition belt is being fed to a weapon. Hand-crank 34 may have a foldable handle 34A that is foldable against a drive arm 34B of the hand-crank to keep the handle out of the way when not in use. While a hand-crank is shown, persons skilled in the art will recognize that a motor may be provided to drive rotation of sprocket 16.

Figure 5:
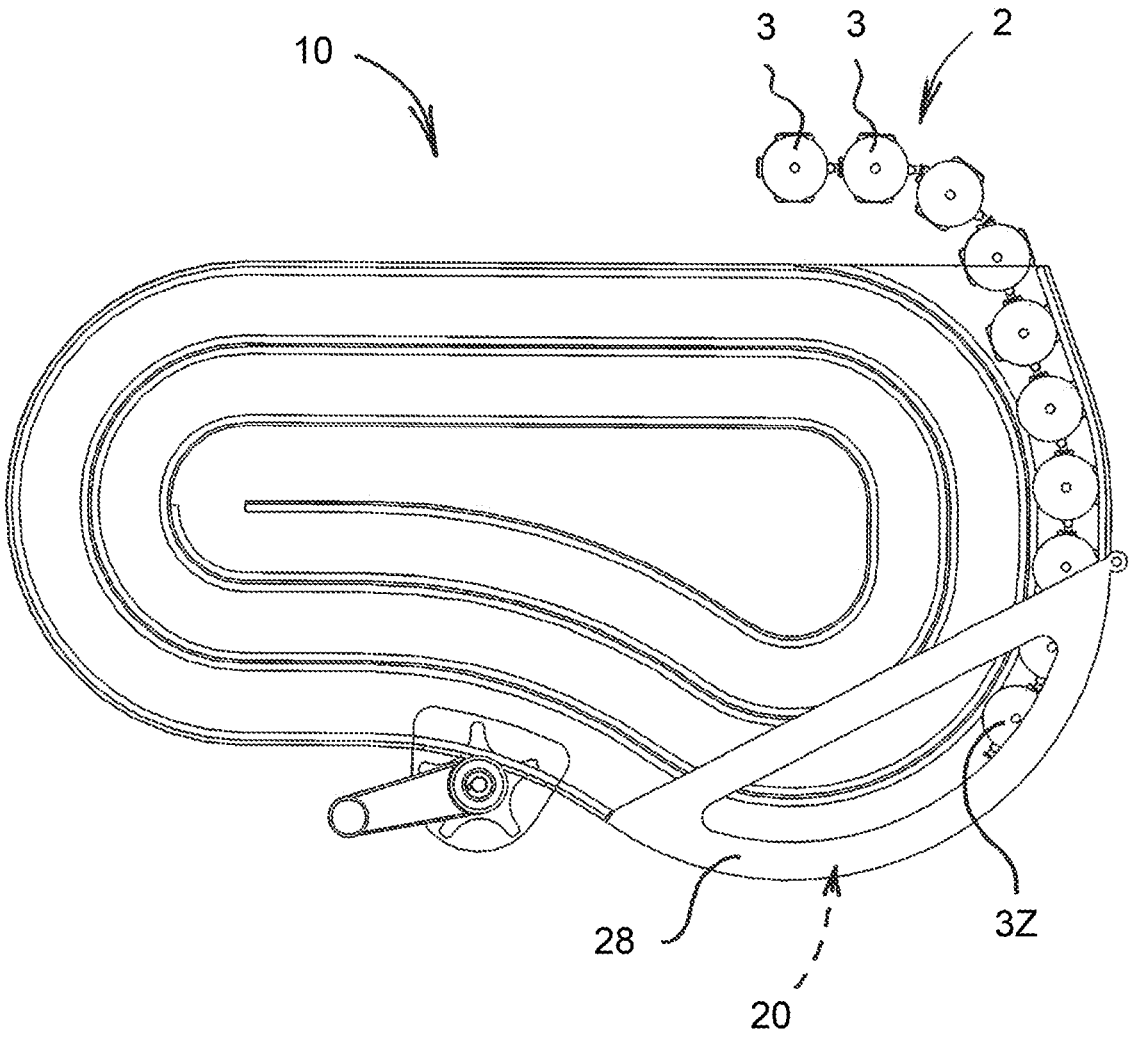
FIG. 5 is a view similar to that of FIG. 3, illustrating the container as it is running low on ammunition and in need of reloading.
Figure 6:
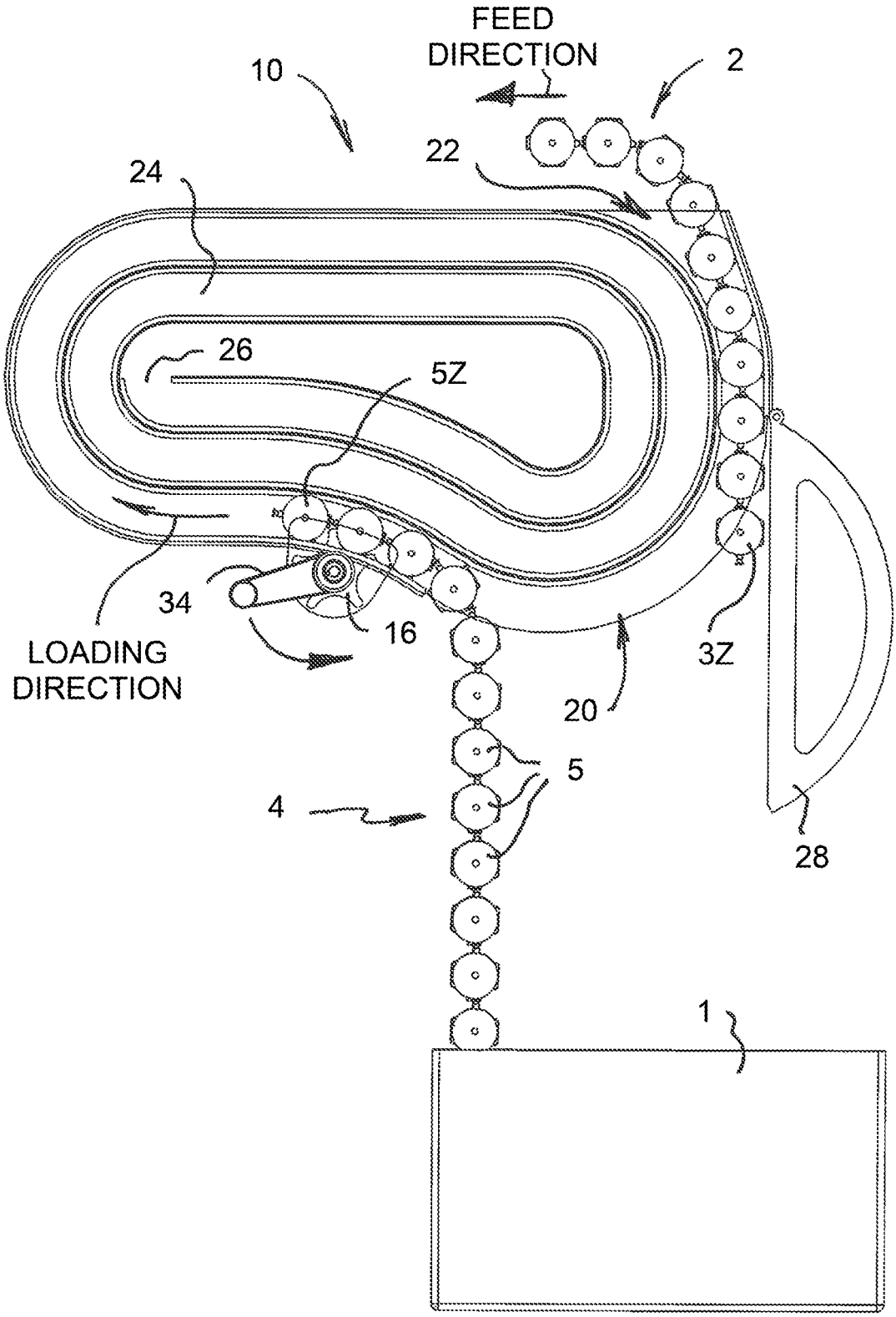
FIG. 6 is a view similar to that of FIG. 3, illustrating the container as reloading is begun.
Figure 7:
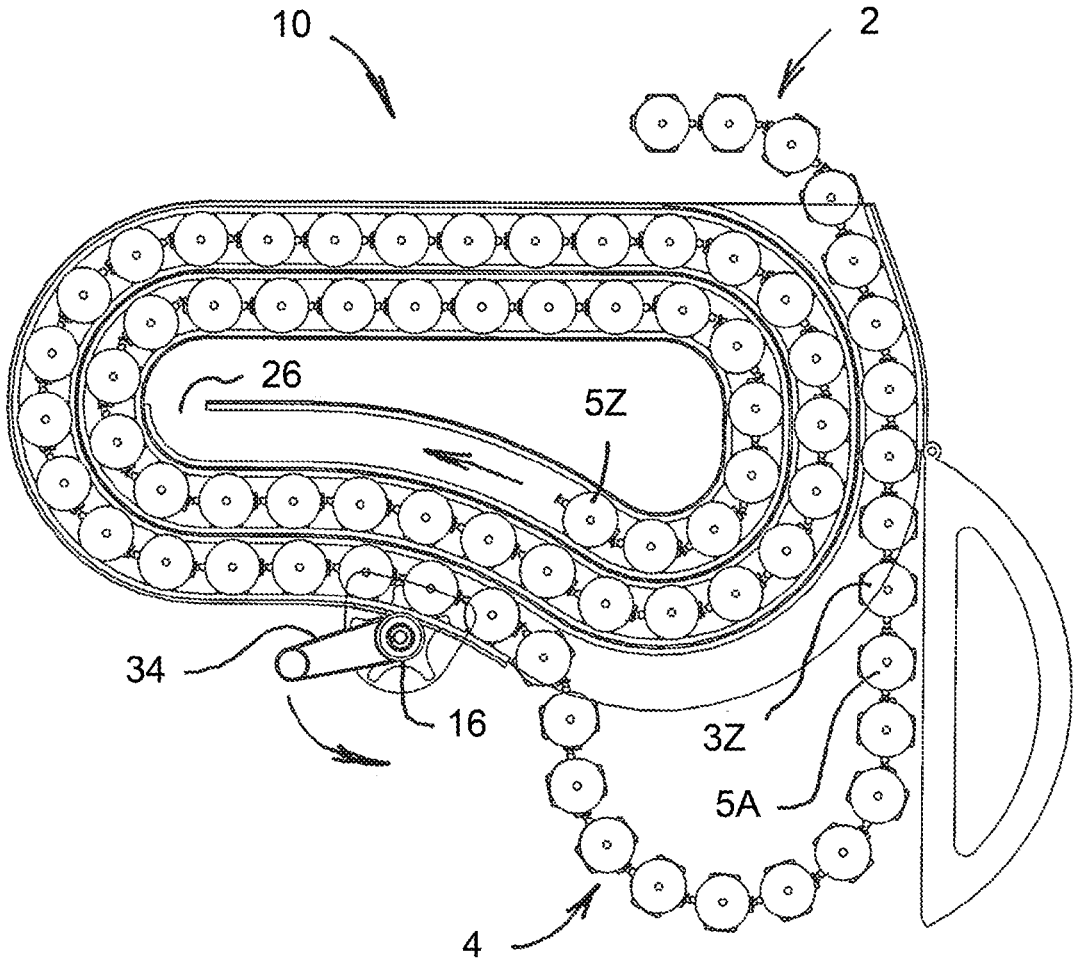
FIG. 7 is a view similar to that of FIG. 3, illustrating the container as reloading continues, wherein a newly loaded ammunition belt is linked to a remaining portion of a prior ammunition belt.
Figure 8:
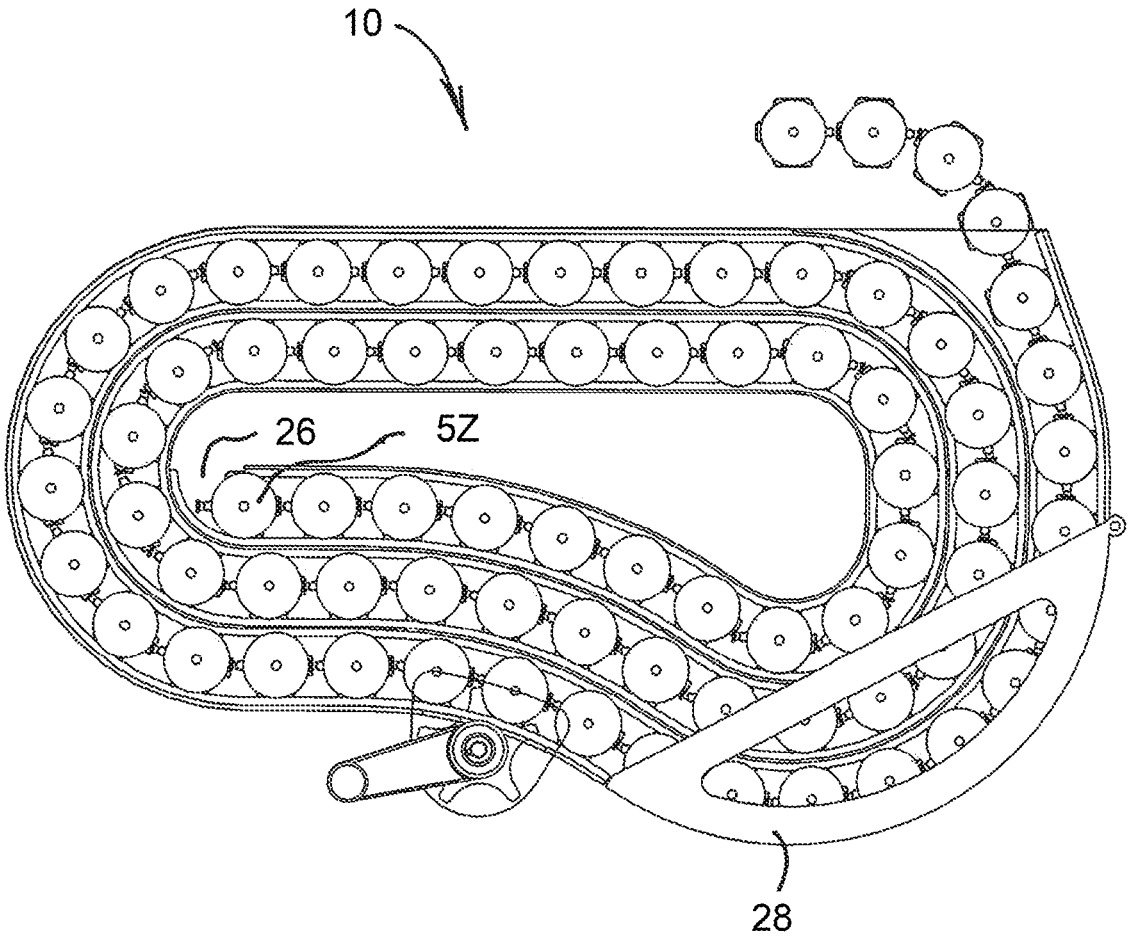
FIG. 8 is a view similar to that of FIG. 3, illustrating the container after reloading has been completed.

A process of reloading ammunition container 10 of the first embodiment will now be described with reference to FIGS. 5-8. As will be understood, sprocket 16 is rotatable about sprocket axis 18 to urge a belt of ammunition along guide path 24 in a loading direction from the loading access opening 20 to the origin 26. FIG. 5 shows ammunition container 10 as it is becoming depleted of a prior ammunition belt 2 having individual rounds 3. Belt 2 is pulled in a weapon feed direction by a feed mechanism associated with an automatic weapon. As may be seen, a trailing round 3Z of belt 2 is at loading access opening 20, which is covered by access cover 28. To reload ammunition container 10, access cover 28 is opened as shown in FIG. 6, and a new ammunition belt 4 having individual rounds 5 is inserted through loading access opening 20. More specifically, a trailing round 5Z of belt 4 is positioned between teeth of sprocket 16, and sprocket 16 is rotated counterclockwise as shown in FIG. 6 to urge belt 4 inward along guide path 24. As will be understood from FIG. 7, a leading round 5A of new belt 4 will emerge from ammunition box 1 and is clipped onto the trailing round 3Z of prior ammunition belt 2. Rotation of sprocket 16 is continued until a trailing round 5Z of new belt 4 reaches origin 26, as illustrated in FIG. 8, thereby completing the reloading process. As will be understood, the at least one guide wall 14A-14C prevents the rounds of ammunition 5 in ammunition belt 4 from touching one another. The driving connection between hand-crank 34 and sprocket 16 may then be released so the hand-crank does not spin as ammunition is fed out of container 10 to a weapon.

A similar process is followed to load ammunition container 10 with a new ammunition belt when no portion of a prior ammunition belt is in the container, except that the leading round 5A of the new belt 4 is inserted up through exit opening 22 to the weapon feed mechanism.

Figure 9:
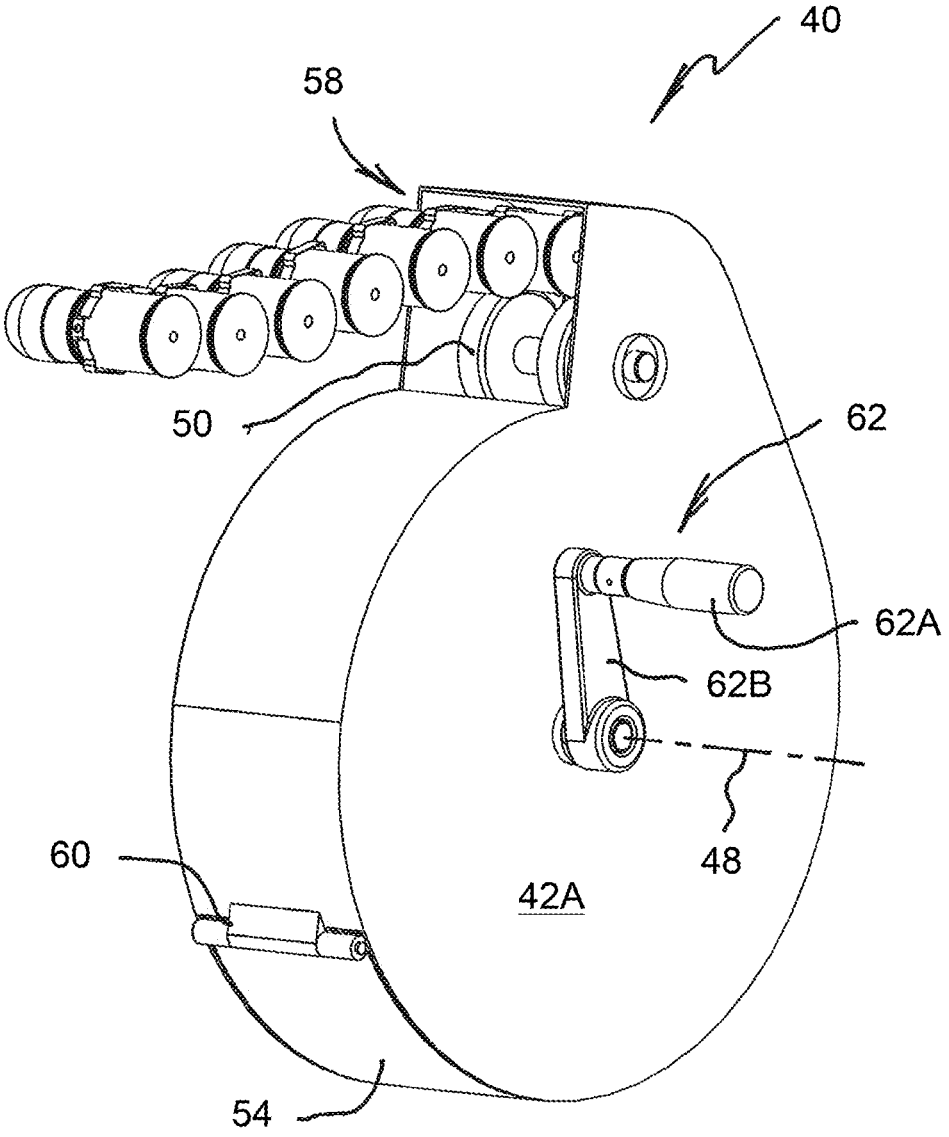
FIG. 9 is a perspective view of an ammunition storage container formed in accordance with a second embodiment of the present invention.
Figure 10:
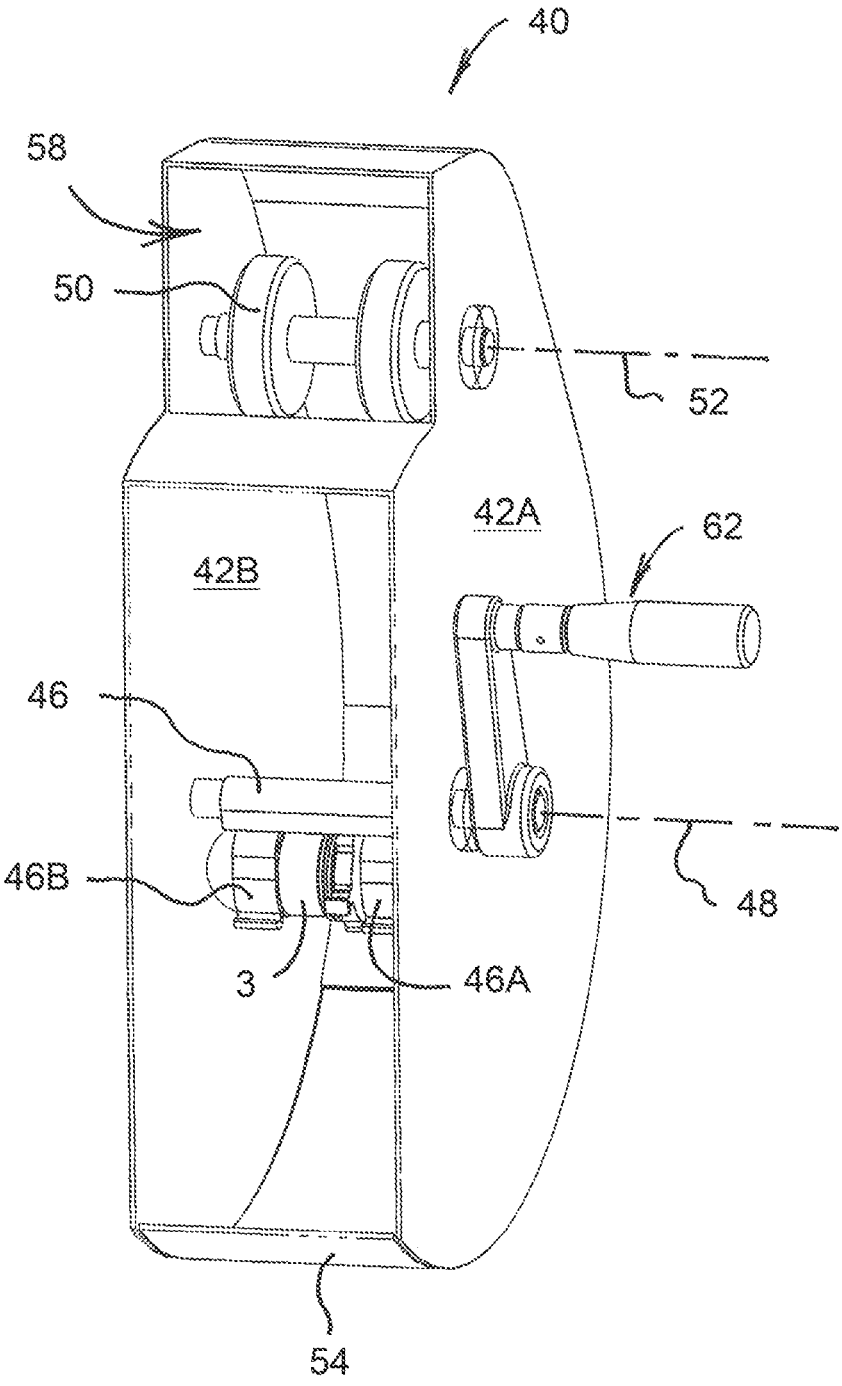
FIG. 10 is another perspective view of the ammunition storage container shown in FIG. 9, sectioned to show internal structure of the ammunition container, wherein a single round of ammunition is shown clamped by an ammunition clamp of the container.
Figure 11:
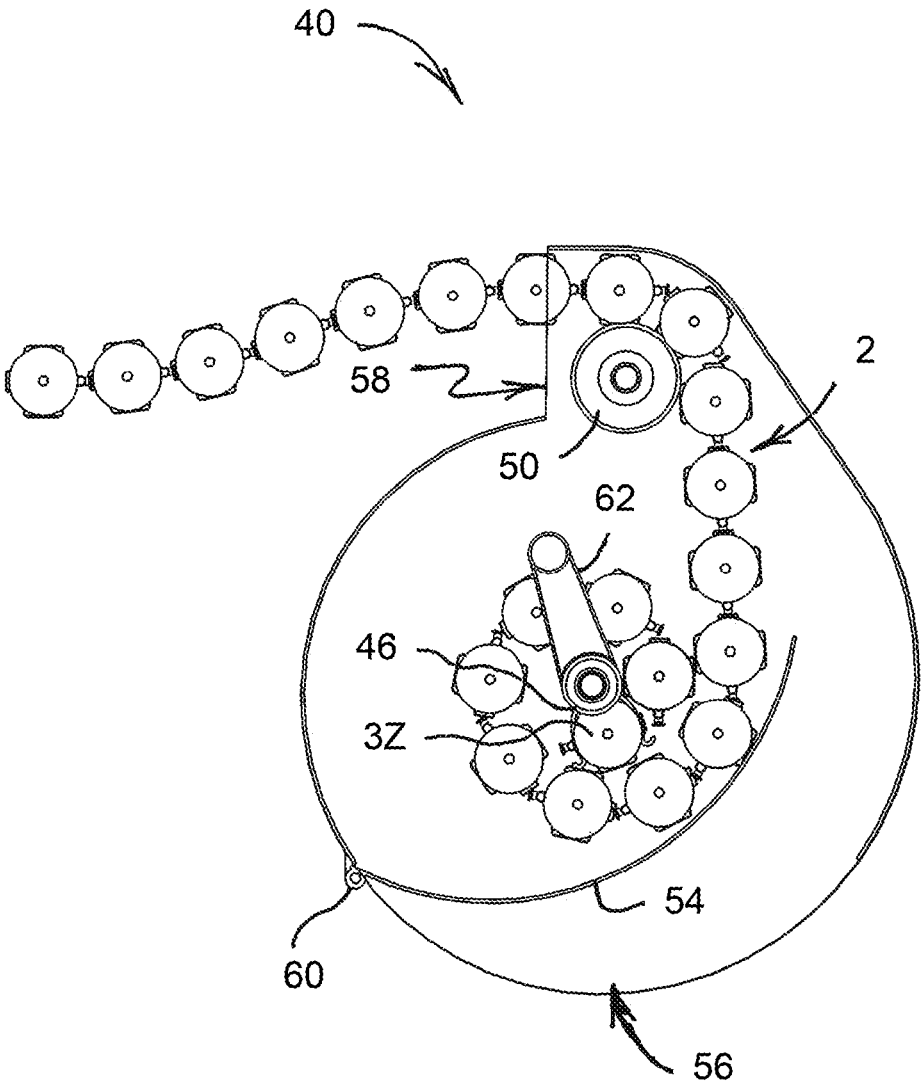
FIG. 11 is a schematic side view of the ammunition storage container shown in FIG. 9, illustrating the container as it is running low on ammunition and in need of reloading.

FIGS. 9-11 show an ammunition container 40 formed in accordance with a second embodiment of the present invention. Like ammunition container 10 of the first embodiment, ammunition container 40 of the second embodiment is configured to be safely reloaded by personnel inside the armored vehicle without disconnecting or removing rounds between an exit opening of the container and the weapon, and provides space-efficient storage of ammunition in a confined environment.

Ammunition container 40 is configured such that an ammunition belt may be wound into the container in the manner of a spool. Ammunition container 40 generally comprises a pair of parallel side walls 42A, 42B, an ammunition clamp 46 mounted between the pair of side walls for rotation about a clamp axis 48 extending normal to the pair of side walls, and a keeper 54 movable relative to the pair of parallel side walls. Ammunition container 40 may further comprise a peripheral wall 44 connecting side walls 42A, 42B, wherein the peripheral wall 44 defines a loading access opening 56 between the pair of side walls and an exit opening 58 between the pair of side walls.

As will be understood from FIG. 11, keeper 54 is spring-biased to exert force on a portion of a wound ammunition belt 2 in a direction toward clamp axis 48 to prevent unwinding and maintain the ammunition belt in a wound condition as the ammunition belt is fed to a weapon. As illustrated by the depicted embodiment, keeper 54 may be hingedly mounted on ammunition container 40 by a hinge 60 to pivot about a hinge axis that is parallel to clamp axis 48. Hinge 60 may incorporate a torsion spring (not shown) for pivotally biasing keeper 54 toward clamp axis 48. While a hinged keeper 54 is shown, other types of keeper mechanisms may be employed, for example a radially biased plunger or retainer. Advantageously, keeper 54 may also be configured to removably cover loading access opening 56.

As best seen in FIG. 10, ammunition clamp 46 is configured to clamp a single round of ammunition 3 such that the round extends parallel to clamp axis 48. In the present embodiment clamp 46 includes a pair of resiliently deflectable C-clamp arms 46A, 46B for releasably gripping the round of ammunition 3. Ammunition clamp 46 may be located at a central region of ammunition container 40 and is rotatable about clamp axis 48 to wind a belt of ammunition about the clamp axis. An additional sprocket-type support (not shown) may be used to help shape the rounds in a spooled configuration during winding. Ammunition container 40 may comprise a hand-crank 62 connected to ammunition clamp 46 for allowing a user to manually rotate ammunition clamp 46 about clamp axis 48. As in the first embodiment described above, hand-crank 62 may be connected to ammunition clamp 46 by a ratchet mechanism (not shown) for enabling rotation of ammunition clamp 46 in a first rotational direction, e.g. clockwise in FIG. 11, while preventing rotation of the ammunition clamp in a second rotational direction opposite to the first rotational direction, e.g. counterclockwise in FIG. 11. As will be understood from description that follows, a ratchet mechanism is desirable to prevent a belt of ammunition from unwinding out of ammunition container 10 during loading. Here again, the connection between hand-crank 62 and ammunition clamp 46 may be releasable to prevent the hand-crank from rotating with ammunition clamp 46 when an ammunition belt is being fed to a weapon, and hand-crank 62 may have a foldable handle 62A that is foldable against a drive arm 62B of the hand-crank to keep the handle out of the way when not in use. While a hand-crank is shown, persons skilled in the art will recognize that a motor may be provided to drive rotation of ammunition clamp 46.

Ammunition container 40 may further comprise an outfeed roller 50 mounted between the pair of side walls 42A, 42B for rotation about a roller axis 52 extending parallel to clamp axis 48. Outfeed roller 50 is spaced from ammunition clamp 46, and may be positioned near exit opening 58 to help guide a belt of ammunition to ensure that the rounds are always pulled tangentially from the spooled winding as the belt unwinds during firing of a weapon.

Figure 12:
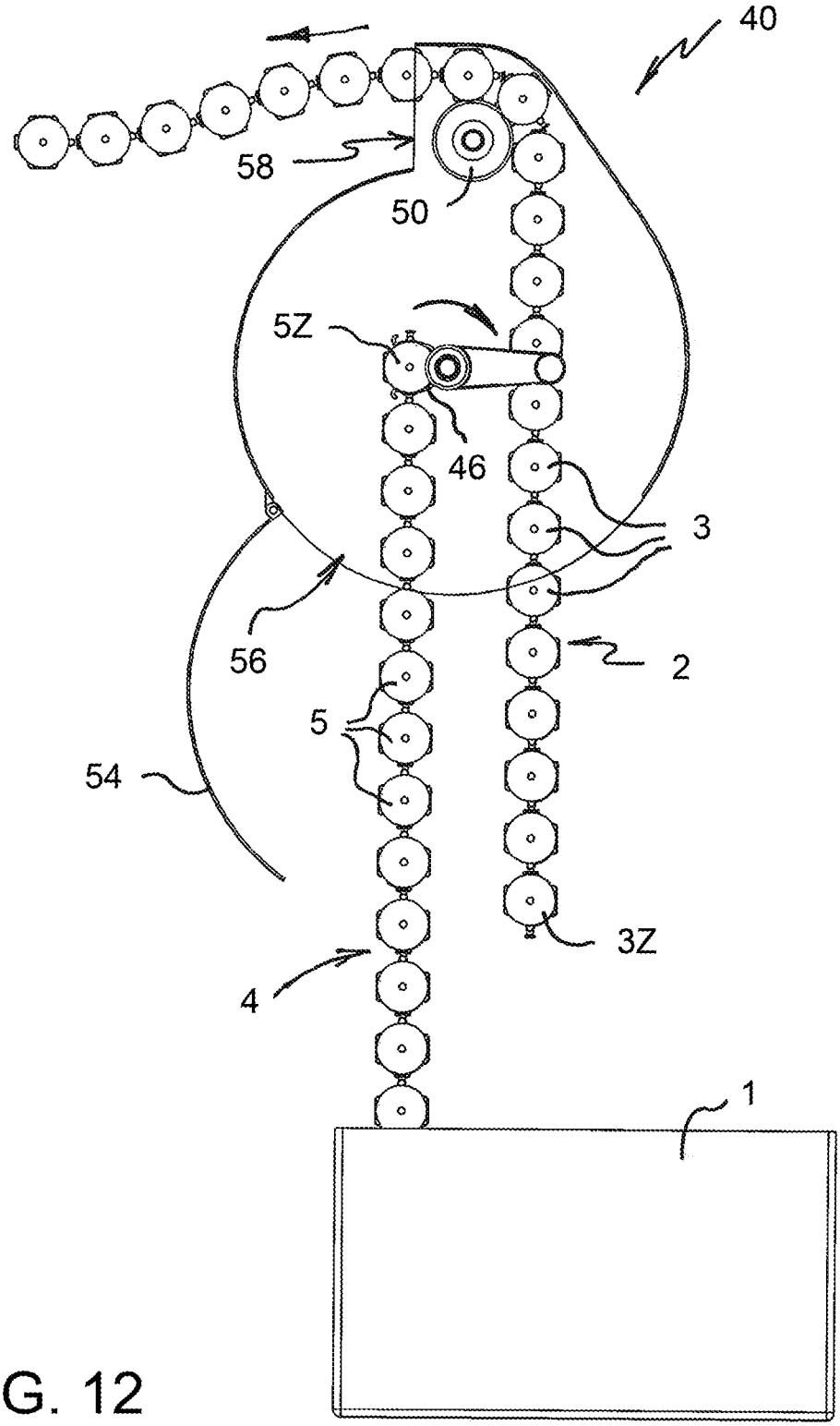
FIG. 12 is a view similar to that of FIG. 11, illustrating the container as reloading is begun.
Figure 13:
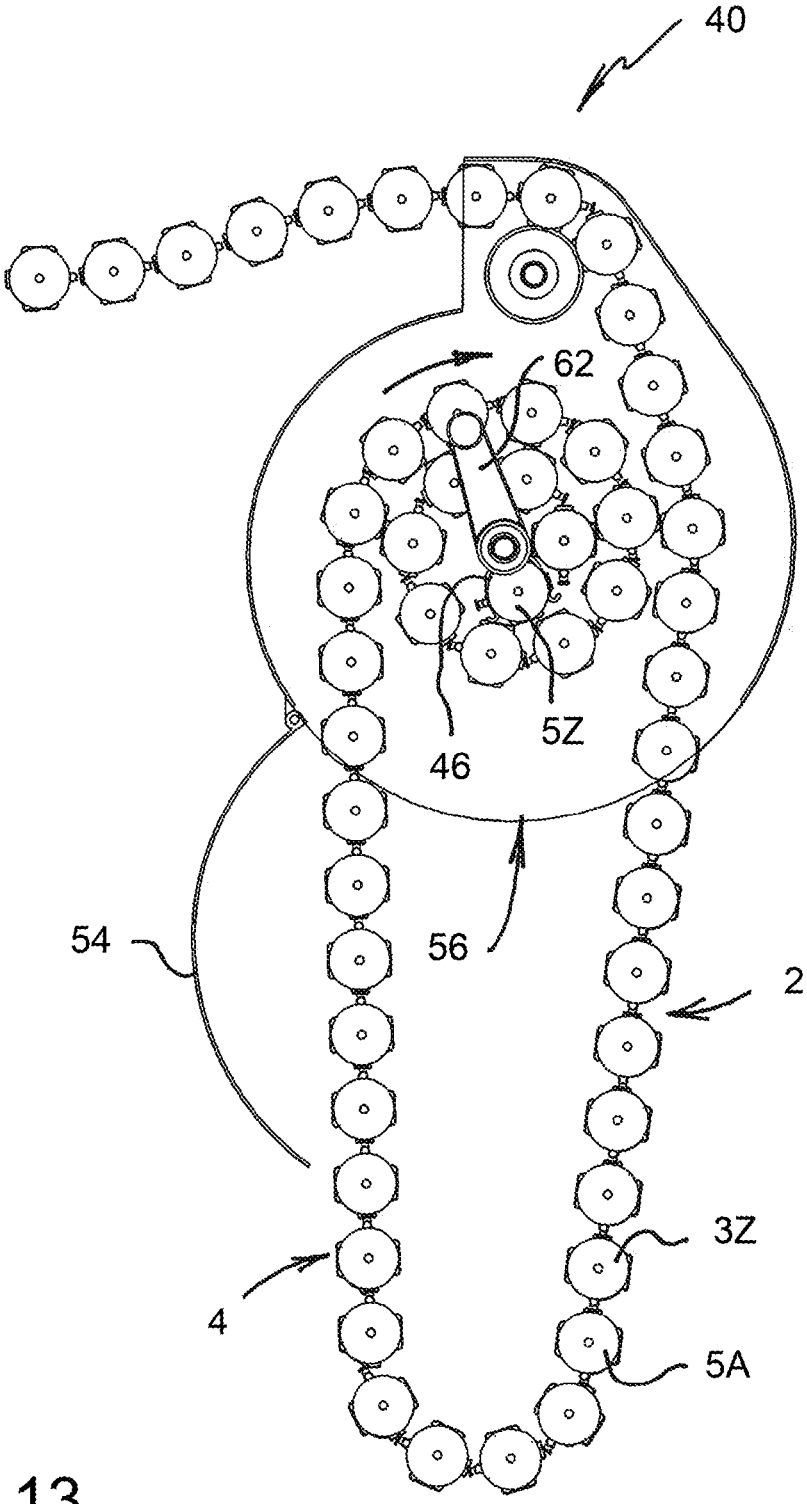
FIG. 13 is a view similar to that of FIG. 11, illustrating the container as reloading continues, wherein a newly loaded ammunition belt is linked to a remaining portion of a prior ammunition belt.
Figure 14:
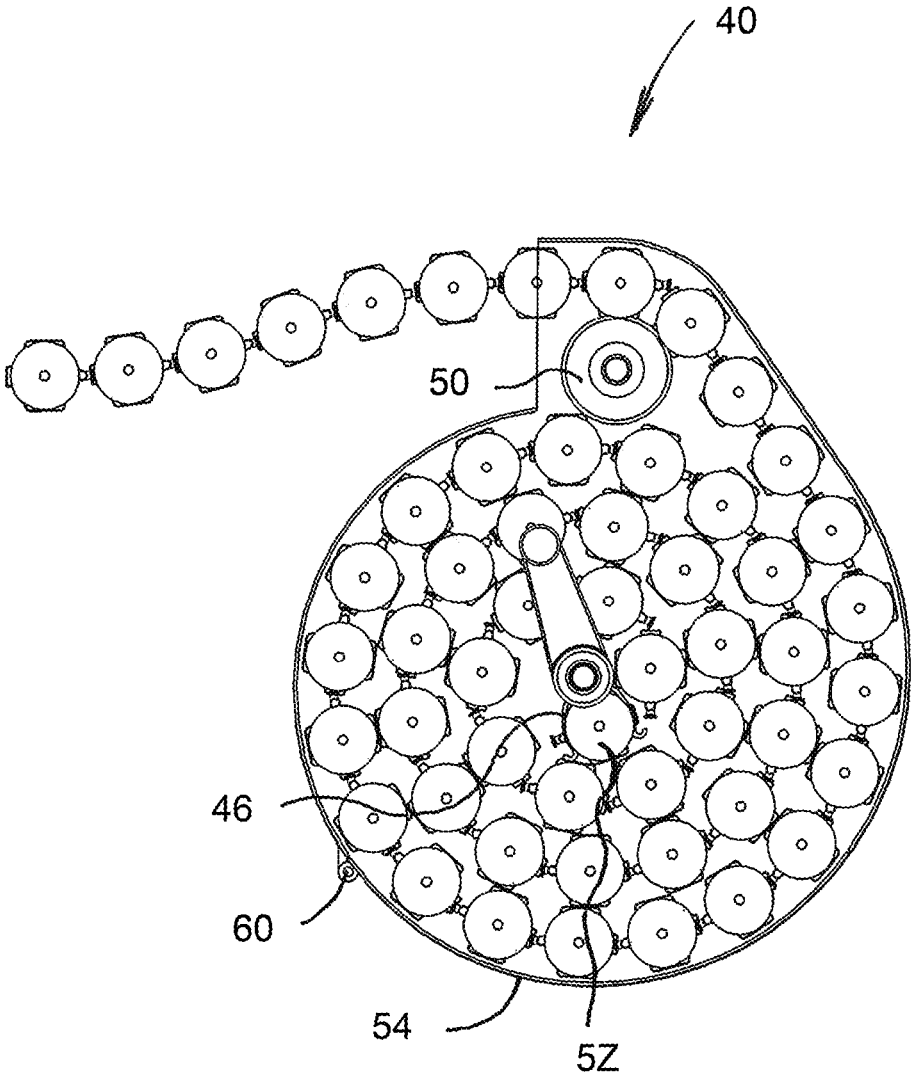
FIG. 14 is a view similar to that of FIG. 11, illustrating the container after reloading has been completed.

A process of reloading ammunition container 40 of the second embodiment will now be described with reference to FIGS. 11-14. FIG. 11 shows ammunition container 40 as it is becoming depleted of a prior ammunition belt 2 having individual rounds 3. Belt 2 is pulled in a weapon feed direction by a feed mechanism associated with an automatic weapon. As may be seen, a trailing round 3Z of belt 2 is clamped in ammunition clamp 46. To reload ammunition container 10, keeper 54 is opened outward as shown in FIG. 12, trailing round 3Z of prior ammunition belt 2 is pulled out of ammunition clamp 46 to permit a trailing portion of belt 2 to unwind, and a trailing round 5Z of new belt 4 is inserted through loading access opening 56 and clamped in ammunition clamp 46. As illustrated in FIG. 13, ammunition clamp 46 is then rotated clockwise to wind new belt 4 onto itself. A leading round 5A of new belt 4 will emerge from ammunition box 1 and is clipped onto the trailing round 3Z of prior ammunition belt 2. Rotation of ammunition clamp 46 is continued until new belt is fully wound and keeper may be closed against the belt, as illustrated in FIG. 14, thereby completing the reloading process. The driving connection between hand-crank 62 and ammunition clamp 46 may then be released so the hand-crank does not spin as ammunition is fed out of container 40 to a weapon. The clamping force exerted by ammunition clamp 46 may be chosen such that the feed mechanism associated with a weapon can pull an ammunition belt with enough force to remove a trailing round from the ammunition clamp if an operator chooses to fire all round before reloading.

A similar process is followed to load ammunition container 40 with a new ammunition belt when no portion of a prior ammunition belt is in the container, except that the leading round 5A of the new belt 4 is inserted up around outfeed roller 50 and through exit opening 58 to the weapon feed mechanism.

An ammunition container 70 formed in accordance with a third embodiment of the present invention is shown in FIGS. 15-25. Ammunition container 70 of the third embodiment is configured to be safely reloaded by personnel inside the armored vehicle without disconnecting or removing rounds between an exit opening of the container and the weapon, and provides space-efficient storage of ammunition in a confined environment. Ammunition container 70 may be used, for example, to store linked ammunition rounds for an MK19 automatic grenade launcher.

Ammunition container 70 of the third embodiment generally comprises a pair of transversely spaced side walls 72A, 72B and a bottom wall 74 connecting side walls 72A, 72B, wherein the pair of side walls define an internal space 75 between them. Side walls 72A, 72B also define an exit opening 82 at a top front region of container 70 and a loading access opening 80 at a top rear of the container. As shown in FIGS. 15-18, side walls 72A, 72B may be parallel to one another.

Ammunition container 70 further comprises a sprocket 76 positioned proximate to loading access opening 80, wherein sprocket 76 is rotatable about a transverse sprocket axis 78 relative to side walls 72A, 72B to guide rounds of ammunition through loading access opening 80 and into the internal space 75. Sprocket 76 may include a first sprocket wheel 76A and a second sprocket wheel 76B each having teeth 77 (see FIG. 19) angularly spaced about sprocket axis 78 to define recesses for receiving individual rounds in a belt of ammunition. Sprocket wheels 76A and 76B may be transversely spaced from one another to providing a space 79 between the sprocket wheels 76A, 76B for accommodating a linkage connecting individual rounds in a belt of ammunition.

Ammunition container 70 may also comprise a transversely extending peg 84 fixed relative to the pair of side walls 72A, 72B at a location above and behind (i.e. rearward from) sprocket 76. Peg 84 may have a free end 85 not covered by either of the pair of side walls 72A, 72B. For example, as depicted in FIGS. 15-18, one of the side walls 72B may include a rear extension 73 not opposed by the other side wall 72A, wherein peg 84 is cantilevered to extend transversely from the rear extension 73.

Figure 19:
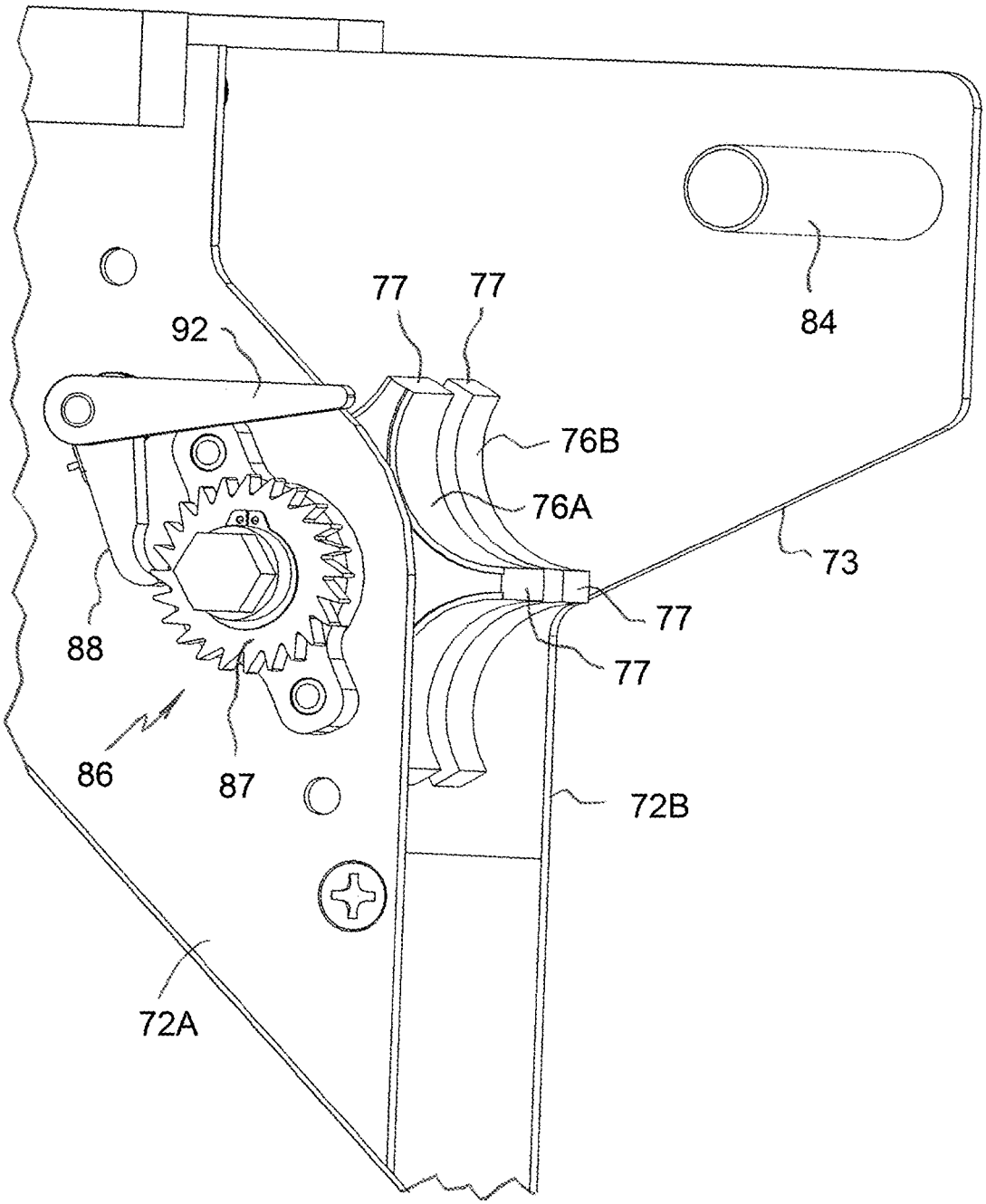
FIG. 19 is an enlarged perspective view of a rear loading end of the ammunition storage container shown in FIGS. 15 and 16.
Figure 20:
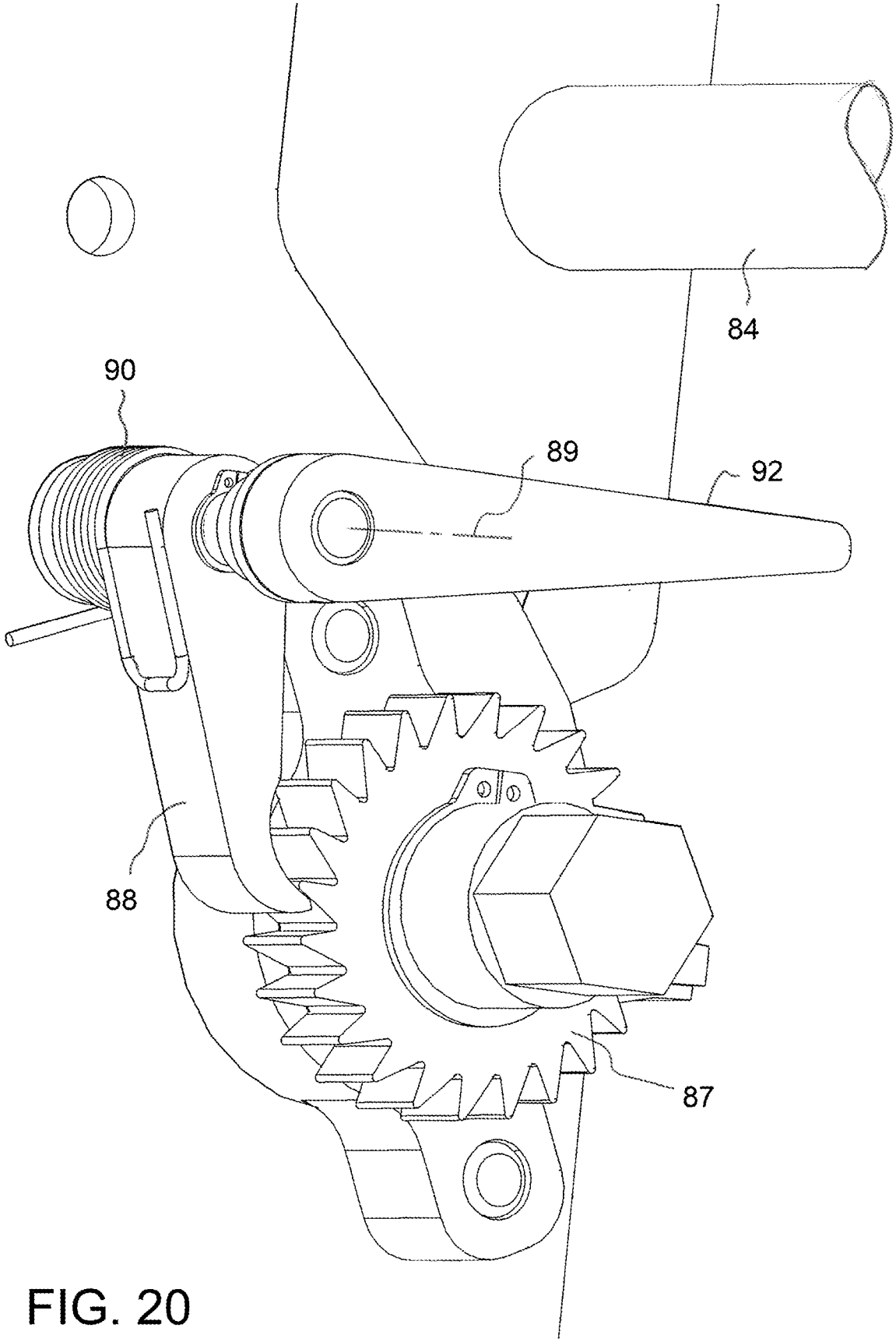
FIG. 20 is an enlarged perspective view showing a ratchet and pawl mechanism of the ammunition storage container shown in FIGS. 15 and 16.

Attention is directed now to FIGS. 19 and 20. Ammunition container 70 may further comprise a ratchet and pawl mechanism 86 arranged to permit rotation of sprocket 76 about sprocket axis 78 in a loading direction (counterclockwise in FIGS. 19 and 20) and to prevent rotation of sprocket 76 about sprocket axis 78 in a direction opposite to the loading direction (clockwise in FIGS. 19 and 20). In the illustrated embodiment, ratchet and pawl mechanism 86 includes a toothed ratchet wheel 87 and a pivotally mounted pawl 88 torsionally biased about a pivot axis 89 by a torsion spring 90 to engage with teeth of ratchet wheel 87 in a well-known manner. A pawl release lever 92 is operable to disengage pawl 88 from ratchet wheel 87 to selectively permit rotation of sprocket 76 about sprocket axis 78 in the direction opposite to the loading direction.

Figure 15:
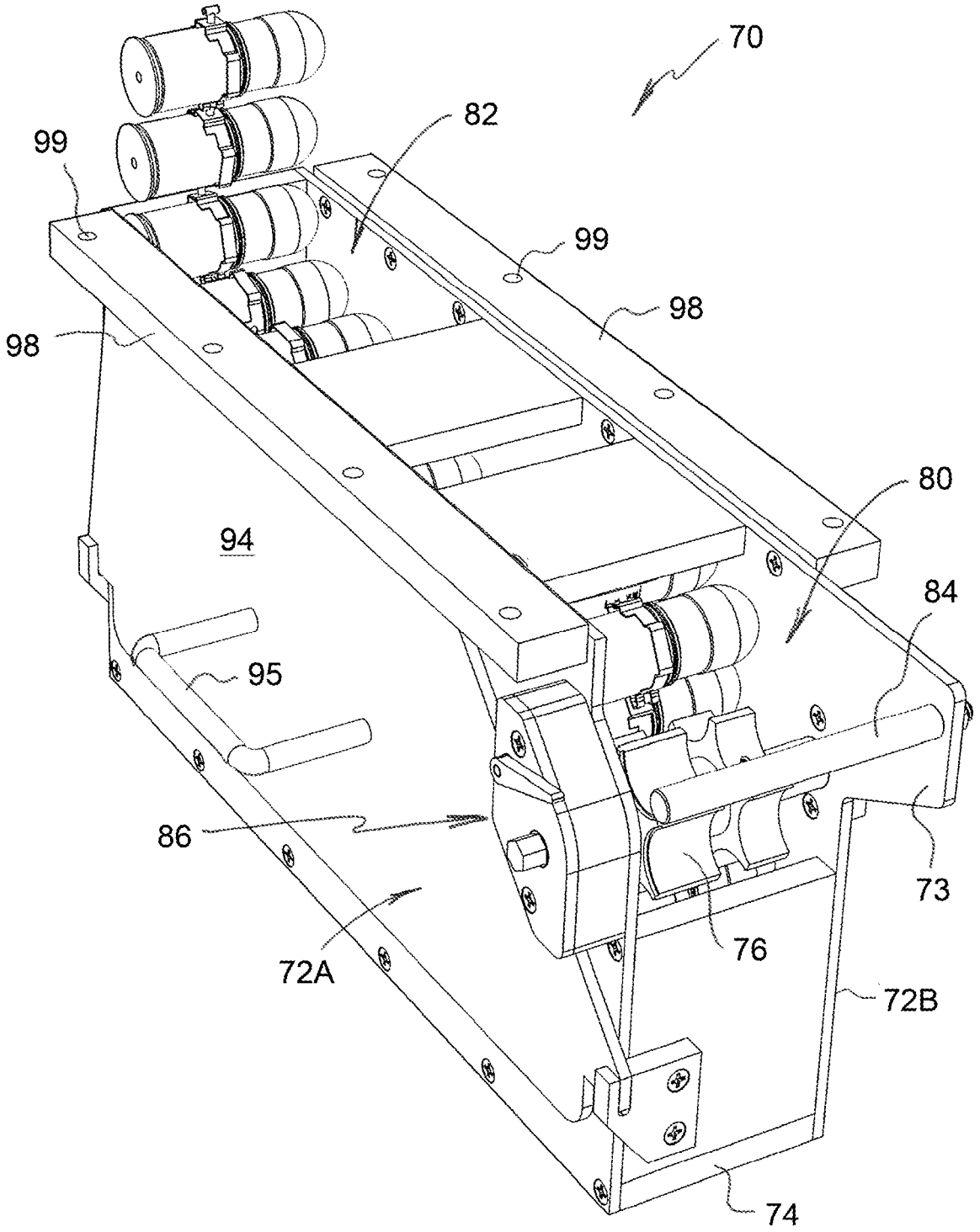
FIG. 15 is a top rear perspective view of an ammunition storage container formed in accordance with a third embodiment of the present invention, wherein the ammunition container is shown loaded with ammunition.
Figure 16:
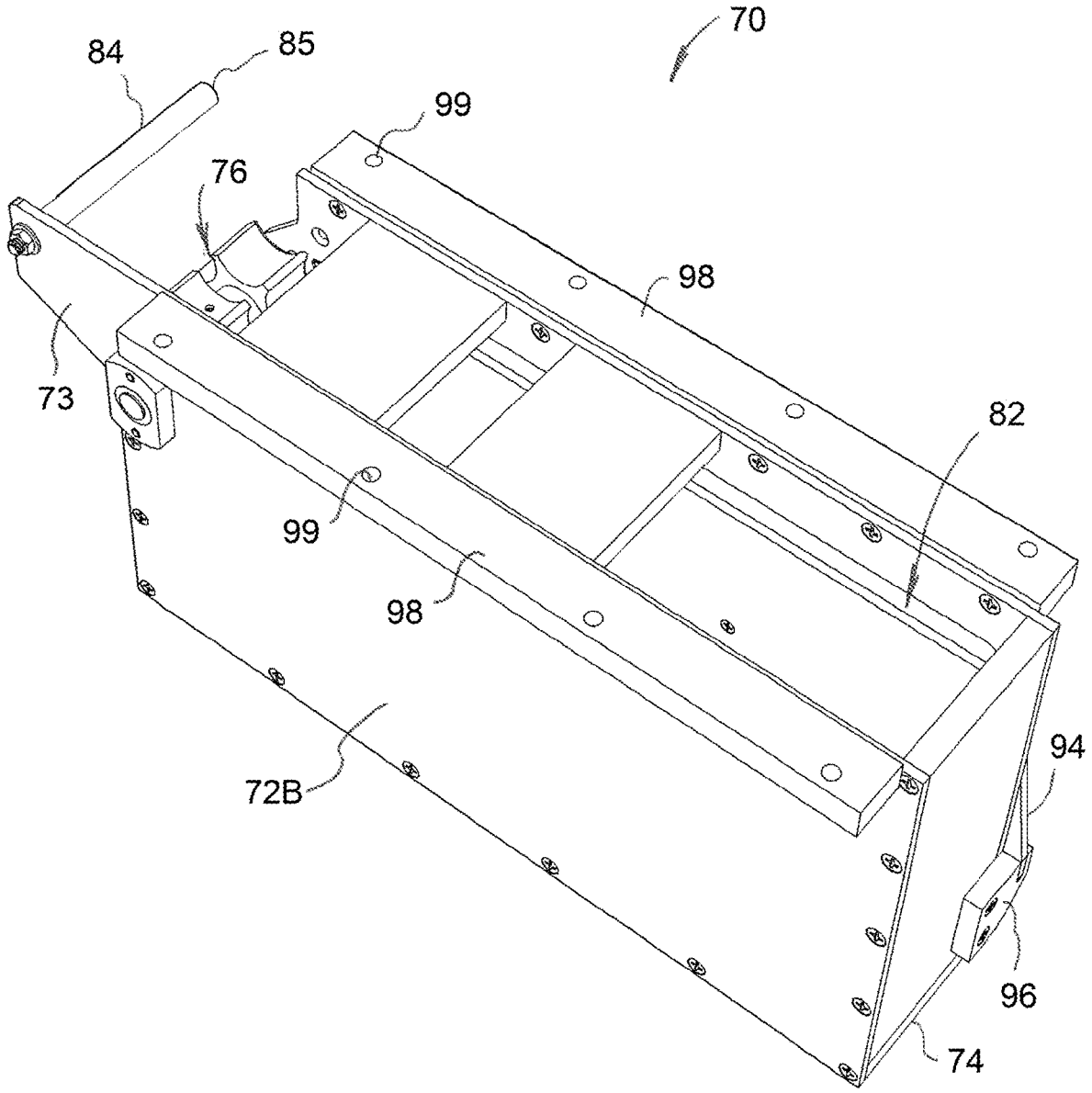
FIG. 16 is a top front perspective view of the ammunition storage container shown in FIG. 15, wherein the ammunition container is empty.
Figure 17:
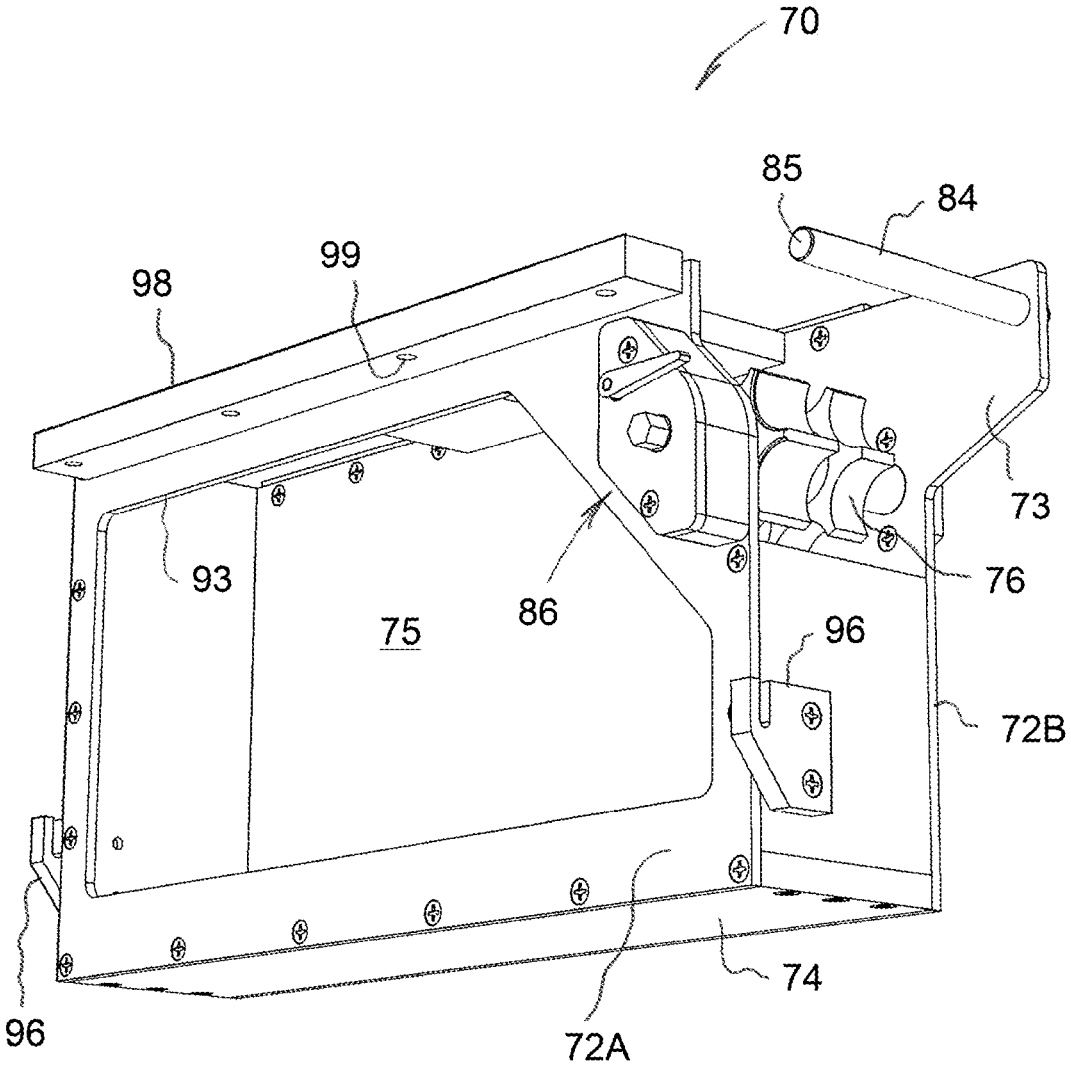
FIG. 17 is a bottom rear perspective view of the empty ammunition storage container shown in FIG. 16, wherein a side wall cover panel of the ammunition container is removed.
Figure 18:
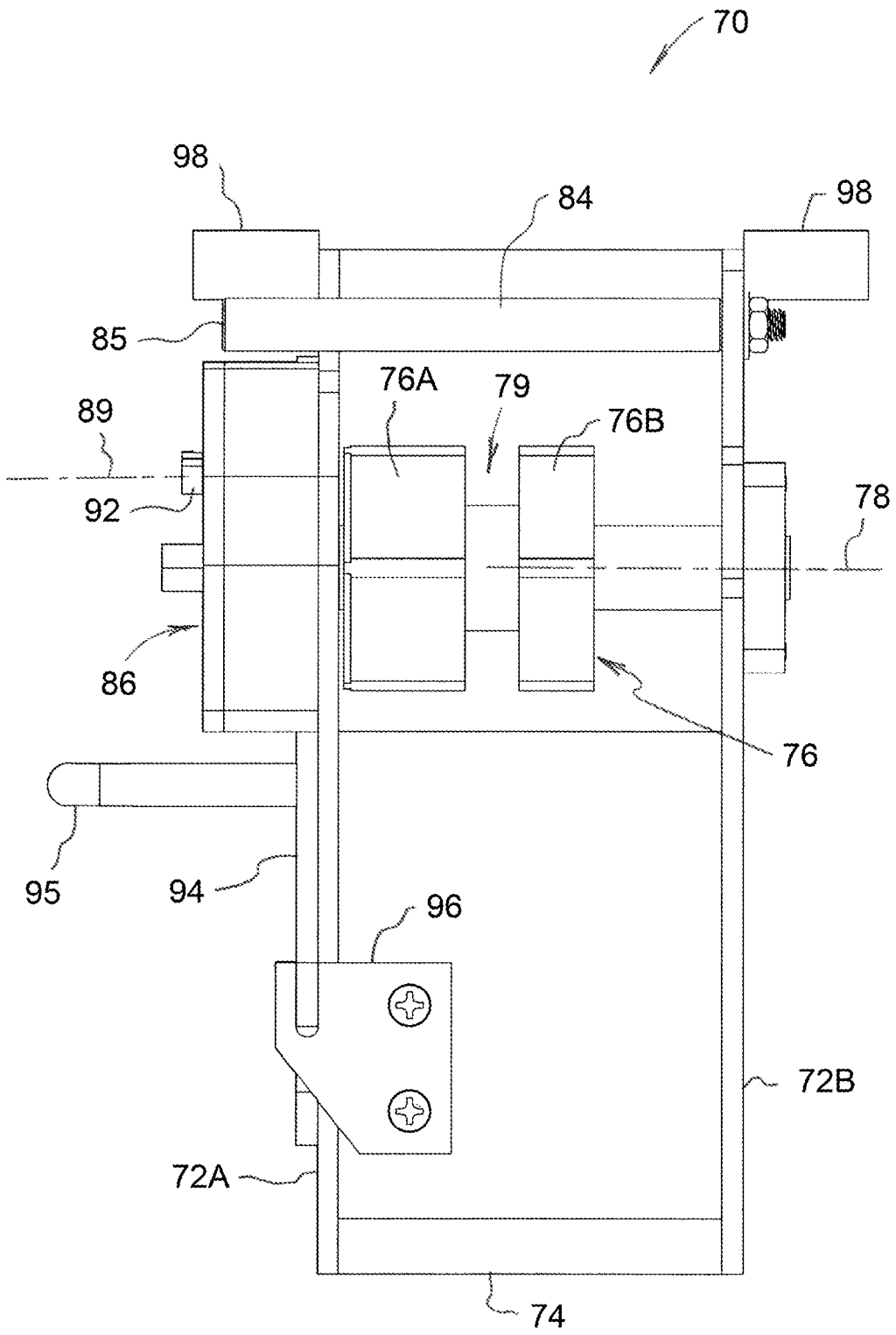
FIG. 18 is a rear elevational view of the empty ammunition storage container shown in FIG. 16.

One of the pair of side walls 72A, 72B may include an access opening 93 and a cover panel 94 covering the access opening 93, wherein the cover panel 94 is displaceable to expose access opening 93. For example, as shown in FIGS. 15 and 18, cover panel 94 may be slidably held by a pair of slotted retention members 96 such that cover panel can be completely removed from ammunition container 70 during loading of ammunition, and then reinstalled after loading is completed. Other arrangements for displaceably mounting cover panel 94 on ammunition container 70 may be used, such as a hinged or pivoting connections. Cover panel 94 may include a handle 95.

Ammunition container 70 may comprise a pair of mounting flanges 98 extending along respective top edges of the pair of side walls 72A, 72B. Each mounting flange 98 may have a plurality of fastener holes 99 for use in mounting ammunition container 70 to overhead structure. For example, ammunition container 70 may be fixedly connected to an interior wall surface of a top wall of a rotatable turret of an armored vehicle using threaded fasteners such that the ammunition container is suspended in an upper region of the compartment and is accessible by operating personnel. The connection may be direct, or via a bracket or other intermediate mounting member.

Figure 21:
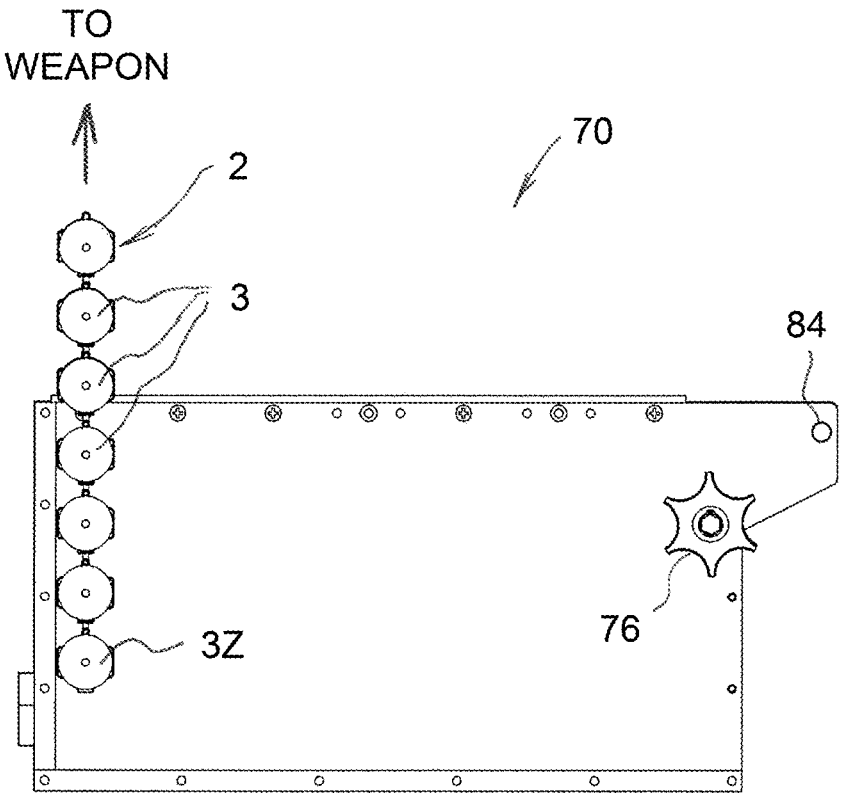
FIG. 21 is a side elevational view of the ammunition storage container shown in FIGS. 15 and 16, wherein the ammunition container is ready for reloading.
Figure 22:
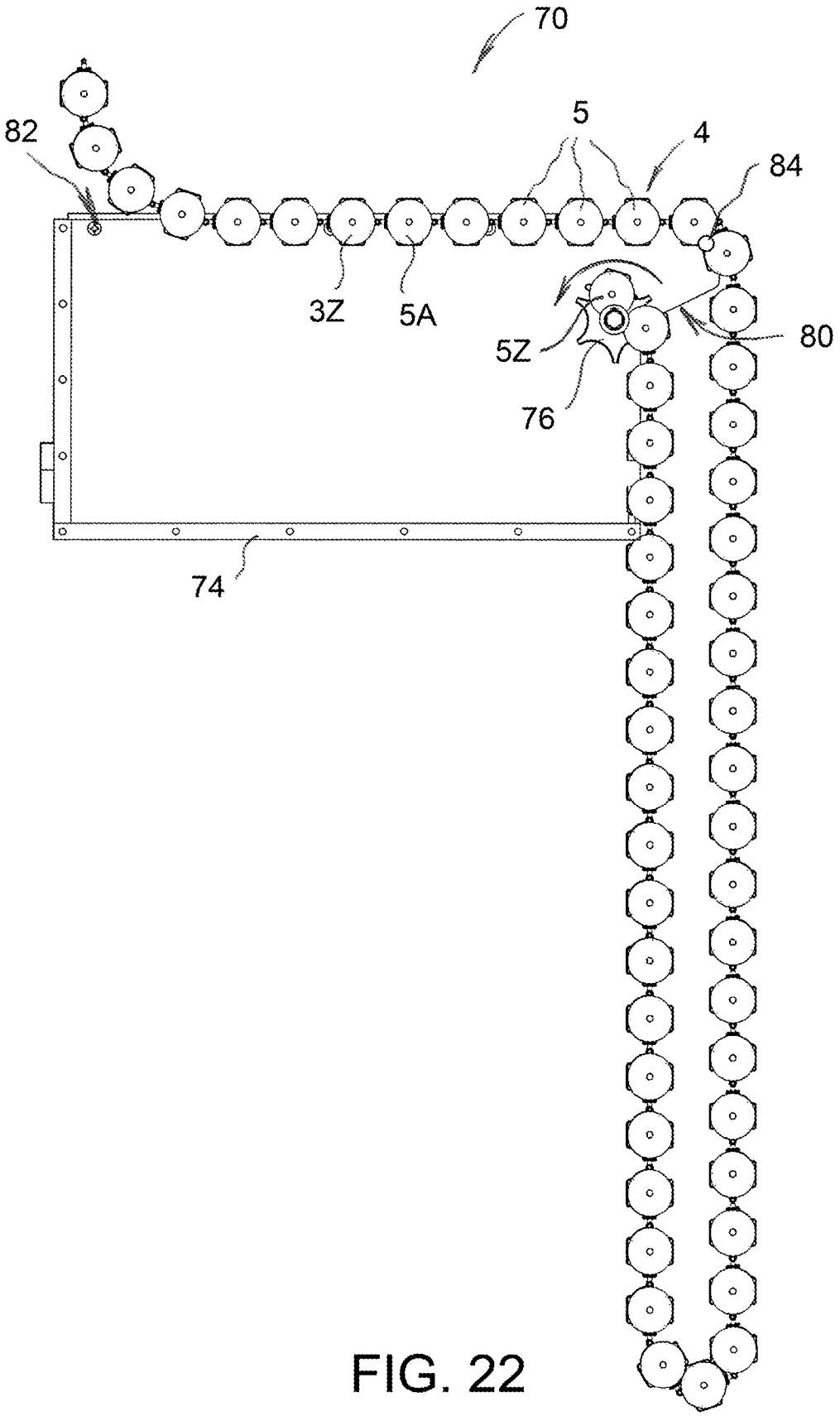
FIG. 22 is a view similar to that of FIG. 21, illustrating a first step in an ammunition reloading process.
Figure 23:
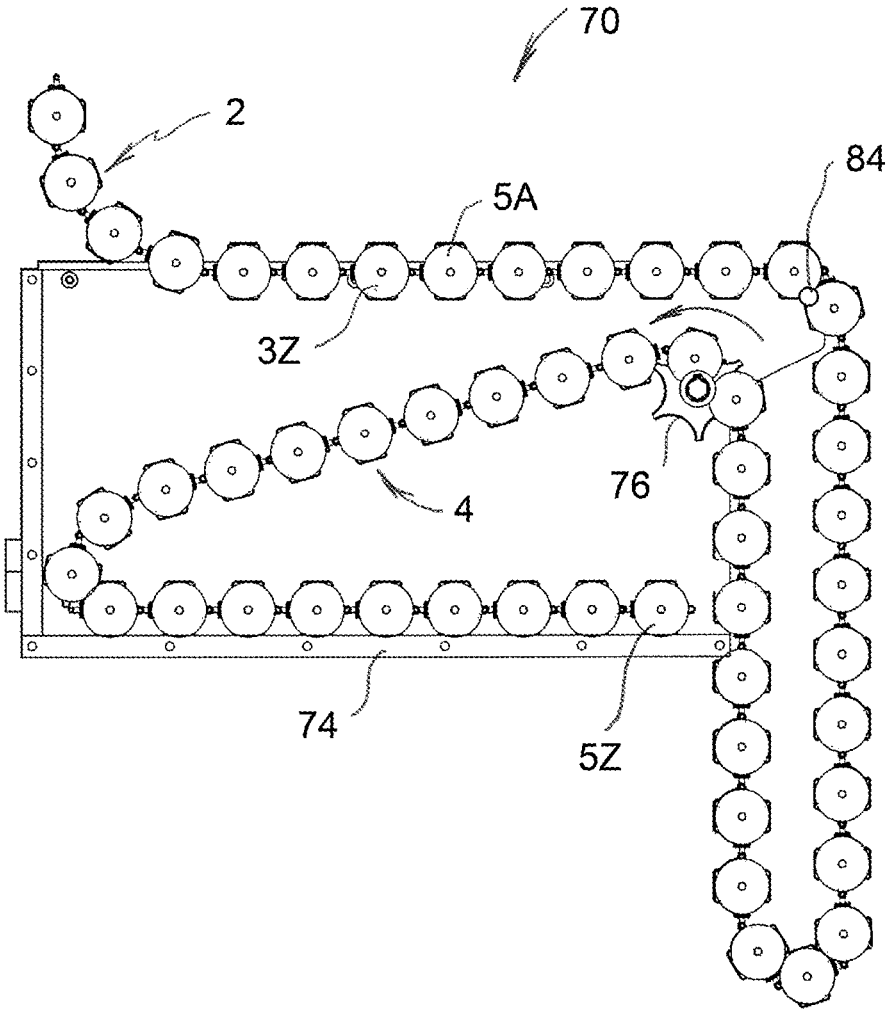
FIG. 23 is a view similar to that of FIG. 21, illustrating a second step in the ammunition reloading process.
Figure 24:
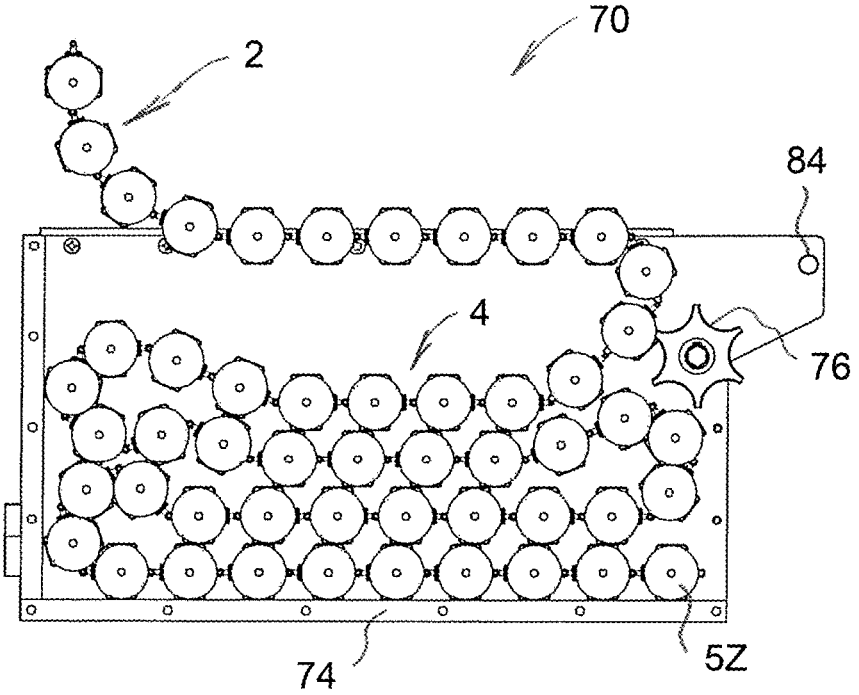
FIG. 24 is a view similar to that of FIG. 21, illustrating a third step in the ammunition reloading process.
Figure 25:
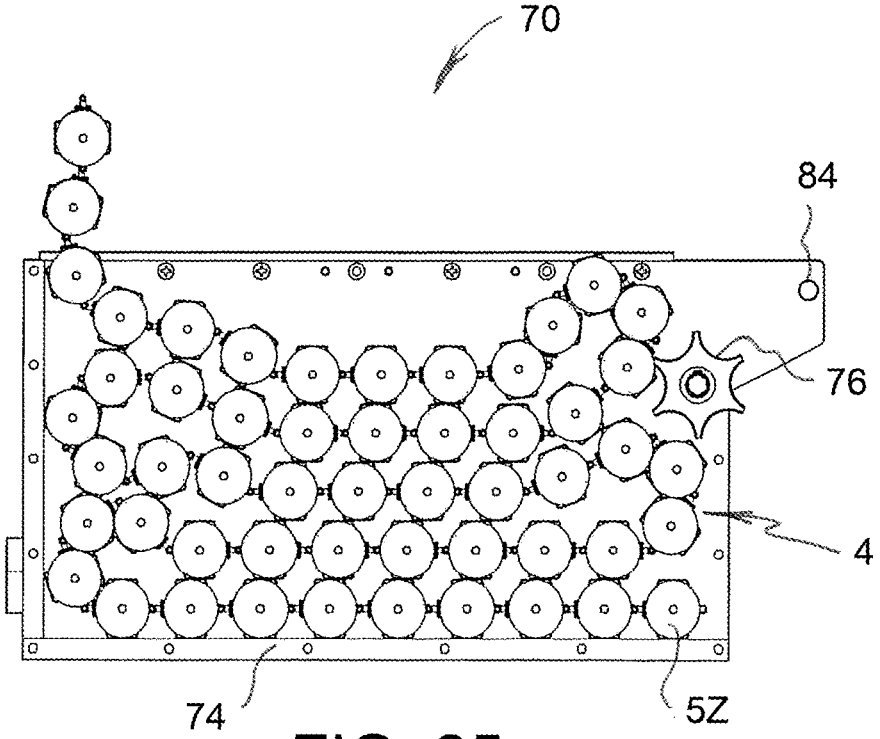
FIG. 25 is a view similar to that of FIG. 21, illustrating the ammunition storage container of FIGS. 15 and 16 after reloading has been completed.
Figure 26:
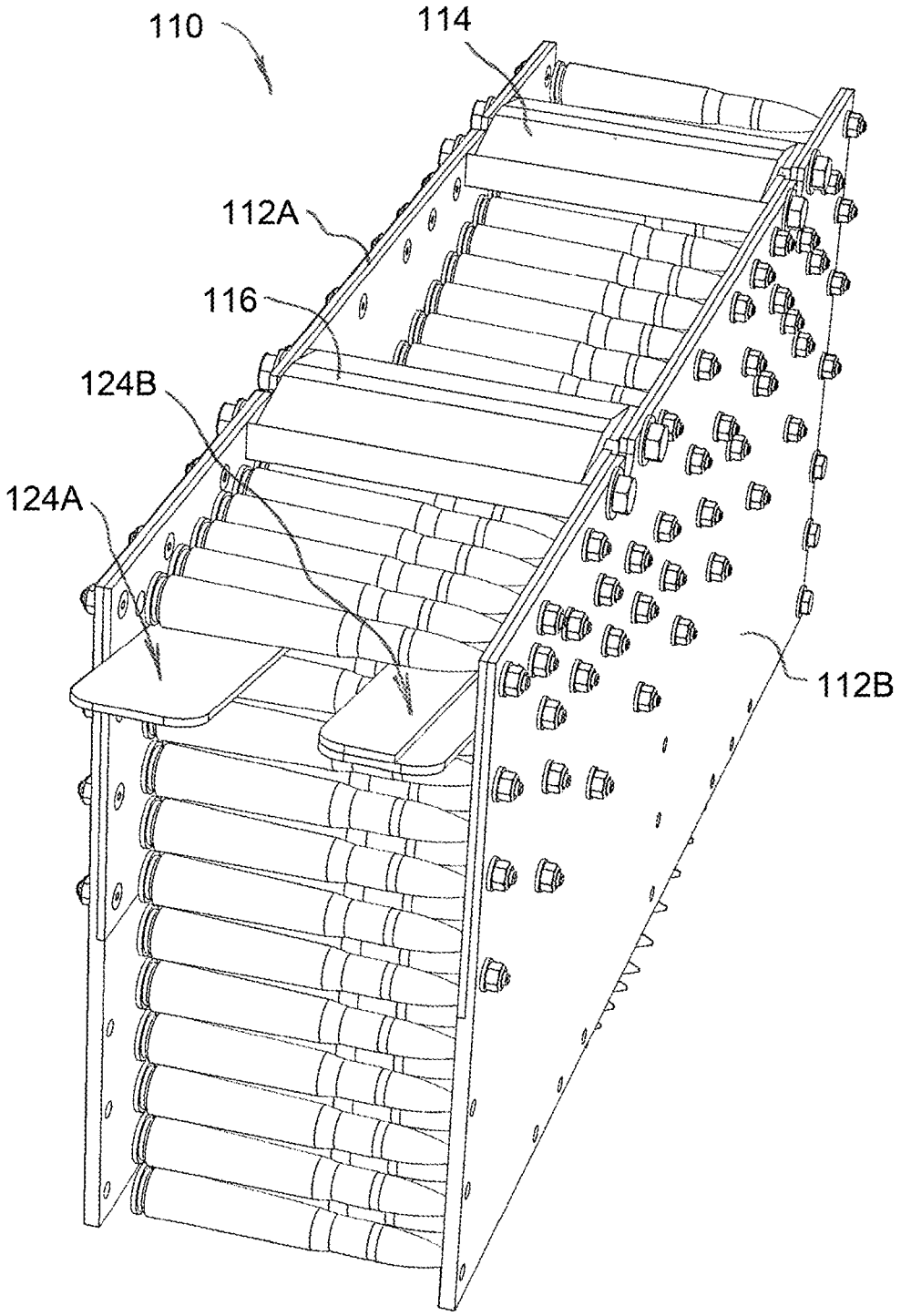
FIG. 26 is a top rear perspective view of an ammunition storage container formed in accordance with a fourth embodiment of the present invention, wherein the ammunition container is shown loaded with ammunition.

FIGS. 21-25 illustrate a process for reloading ammunition container 70 with an additional belt of linked ammunition. In FIG. 21, the remaining rounds 3 of a prior ammunition belt 2 are shown. As may be understood, belt 2 is pulled in a weapon feed direction by a feed mechanism associated with an automatic weapon. A trailing round 3Z of belt can be seen in FIG. 21. To reload ammunition container 70, a leading end of a new ammunition belt 4 having individual rounds 5 is draped around peg 84 and a leading round 5A of new belt 4 is clipped to trailing round 3Z of prior belt 2 as shown in FIG. 22. A trailing end of new belt 4 is positioned on sprocket 76 for guided insertion into container 70, such that new belt forms a U-shaped dip between peg 84 and sprocket 76. Peg 84 is advantageously spaced from sprocket 76 in a rearward direction such that ammunition rounds in the adjacent vertical portions of the U-shaped dip do not contact one another. Referring now to FIG. 23, the trailing end of new belt 4 is pulled into the interior of container 70, causing sprocket 76 to rotate counterclockwise in the view of FIG. 23, and a trailing round 5Z of new belt 4 is positioned at a lower rear corner of container 70 diagonally opposite exit opening 82. A first layer of new belt 4 is then arranged rear-to-front along bottom wall 74. Belt 4 may then be looped around and a second layer may be arranged front-to-rear over the first layer. As shown in FIG. 24, this process may be repeated to form additional layers until the slack in belt 4 is taken up and it is necessary to remove new belt 4 from peg 84 to load the remaining rounds 5. FIG. 25 shows container 70 after reloading is completed.

The reloading process shown in FIGS. 21-25 assumes that the new ammunition belt 4 has forty-eight rounds, however a new belt having thirty-two rounds or some other number of rounds may be loaded in substantially the same manner. Rather than draping the leading end of new belt 4 over peg 84, personnel may drape a trailing end of prior belt 2 over peg 84 and clip the leading round 5A of new belt 4 to a vertically suspended trailing round 3Z of prior belt 2 at a location outside of container 70. A similar process may also be followed to load ammunition container 70 with a new ammunition belt when no portion of a prior ammunition belt is in the container, except that the leading round 5A of the new belt 4 is inserted up through exit opening 82 to the weapon feed mechanism.

An ammunition container 110 formed in accordance with a fourth embodiment of the present invention is shown in FIGS. 26-32. Ammunition container 110 of the fourth embodiment can be safely reloaded by personnel inside the armored vehicle without disconnecting or removing rounds between an exit opening of the container and the weapon, and provides space-efficient storage of ammunition in a confined environment. Ammunition container 110 may be used, for example, to store linked ammunition rounds for an M2 machine gun.

Ammunition container 110 of the fourth embodiment generally comprises a pair of transversely spaced side walls 112A, 112B and at least one bridge member 113, 114, and/or 116 connecting the side walls 112A, 112B. The pair of side walls define an internal space 115 between them. Side walls 112A, 112B also define a rear opening 118 and a bottom opening 120 continuous with rear opening 118. Rear opening 118 and bottom opening 120 allow access to internal space 115. As illustrated in FIGS. 26-29, rear opening 118 may extend over the entire height of side walls 112A, 112B, and bottom opening 120 may extend over substantially the entire length of side walls 112A, 112B. Side walls 112A, 112B may be parallel to one another.

In the illustrated embodiment, ammunition container 110 includes a front bridge member 113, a first top bridge member 114, and a second top bridge member 116. Each of the top bridge members 114, 116 may include one or more fastener holes 117 for use in mounting ammunition container 110 to overhead structure. For example, ammunition container 110 may be fixedly connected to an interior wall surface of a top wall of a rotatable turret of an armored vehicle using threaded fasteners such that the ammunition container is suspended in an upper region of the compartment and is accessible by operating personnel. The connection may be direct, or via a bracket or other intermediate mounting member.

Figure 27:
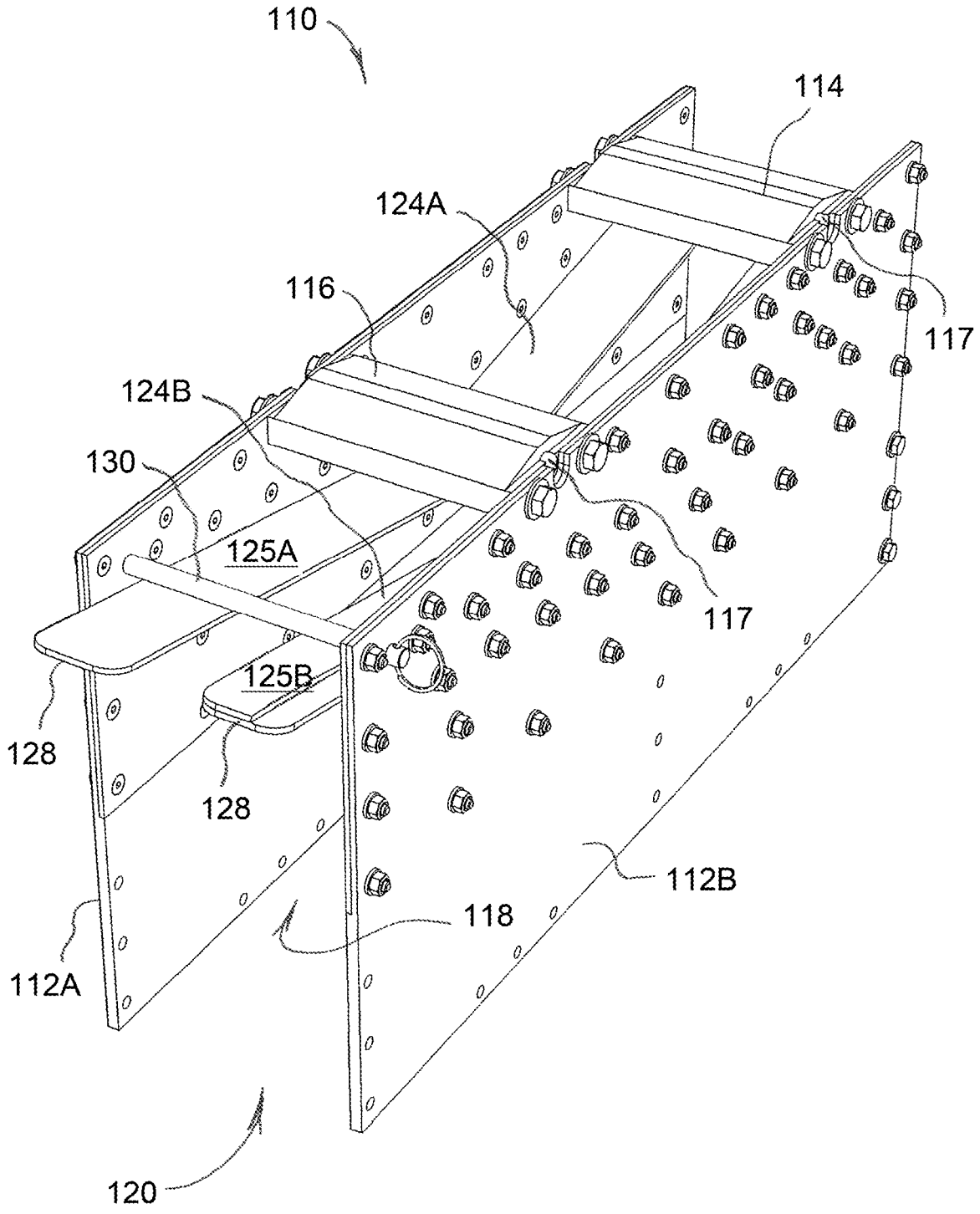
FIG. 27 is a top rear perspective view of the ammunition storage container shown in FIG. 26, wherein the ammunition container is empty.
Figure 28:
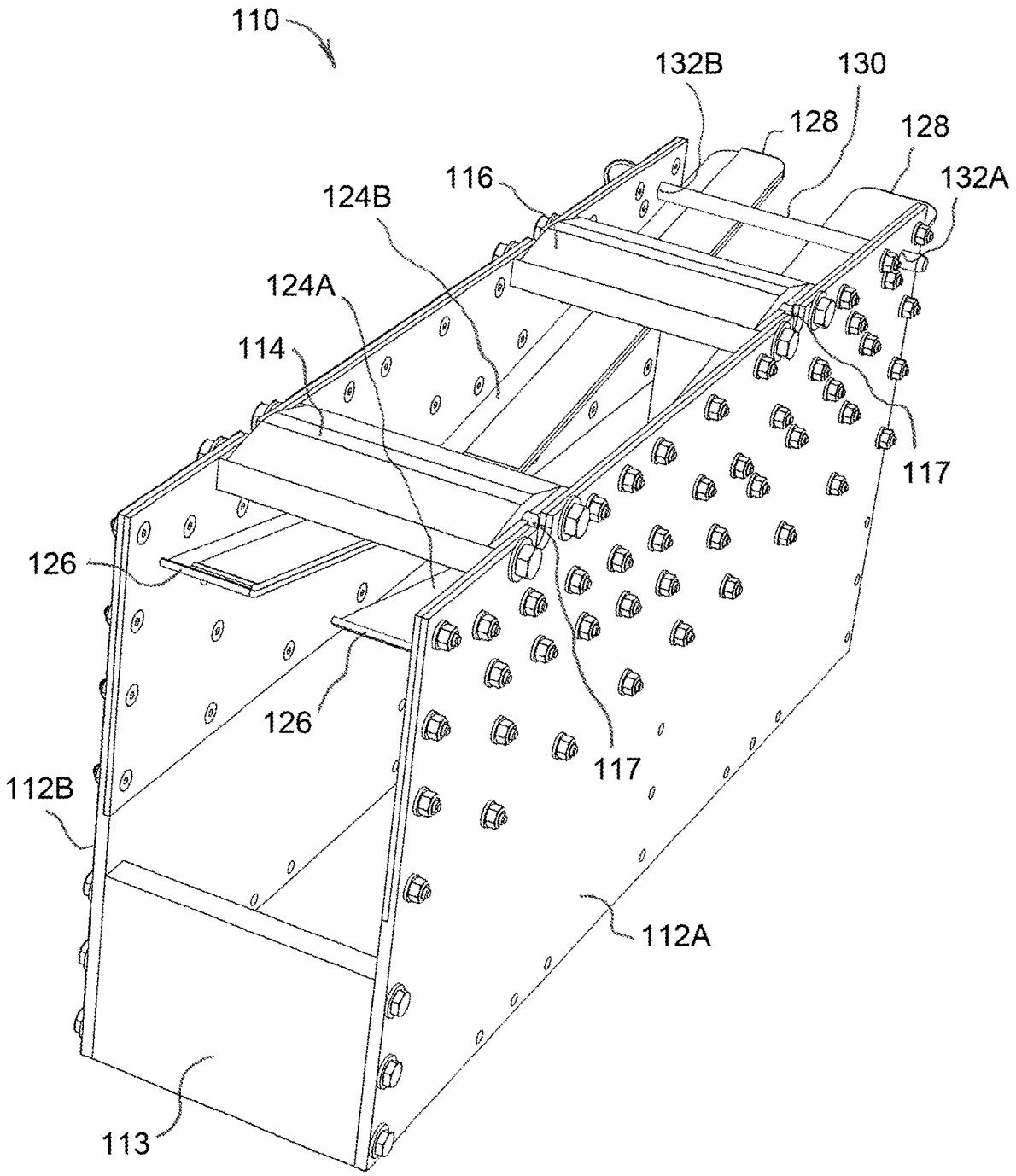
FIG. 28 is a top front perspective view of the empty ammunition storage container shown in FIG. 27.
Figure 29:
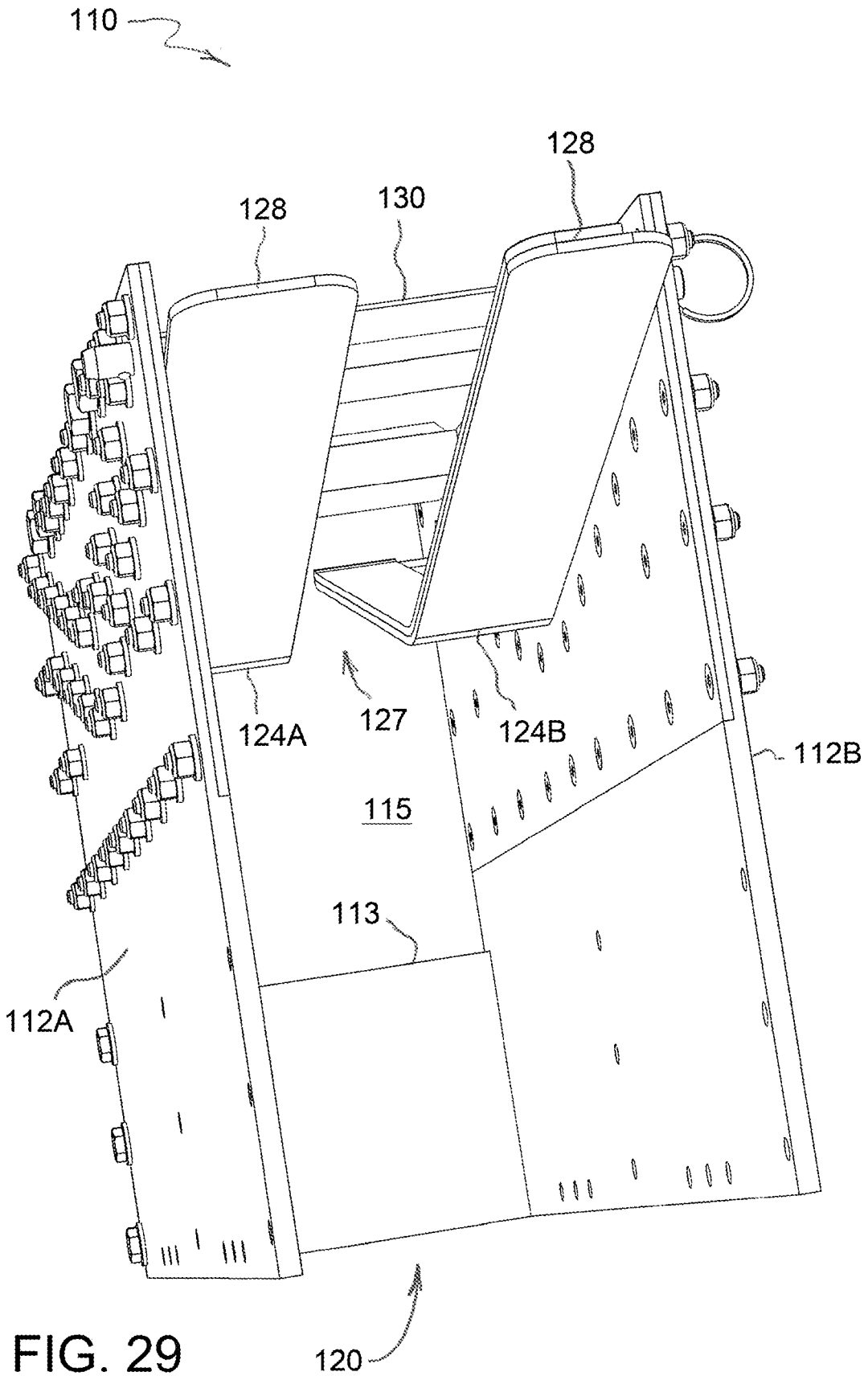
FIG. 29 is a bottom rear perspective view of the empty ammunition storage container shown in FIG. 27.

Ammunition container 110 of the fourth embodiment further comprises a pair of longitudinal support rails 124A, 124B for supporting hanging ammunition. Support rails 124A, 124B are respectively mounted to an inner surface of a corresponding one of the pair of side walls 112A, 112B. Each support rail 124A, 124B includes a front end 126 and a rear end 128. As best seen in FIG. 27, each of the pair of support rails 124A, 124B may extend through rear opening 118 such that the rear end 128 of each support rail 124A, 124B is located outside of the internal space 115 and is easily accessible during an ammunition reloading operation. Support rails 124A, 124B are laterally spaced from one another to provide an intermediate slot 127 through which a flexible linkage connecting rounds of an ammunition belt may extend. In the illustrated embodiment, one of the pair of support rails 124B has an upwardly facing support surface 125B that is raised relative to an upwardly facing support surface 125A of the other support rail 124A. This feature may be advantageous in supporting ammunition rounds having a reduced diameter at one end (i.e. a pointed tip) in a level manner. Support rails 124A, 124B may be inclined slightly downward toward a middle region of container 110 to better retain hanging ammunition.

Ammunition container 110 may also comprise a removable pin 130 extending transversely through aligned holes 132A, 132B in side walls 112A, 112B near a top rear corner of the ammunition container. Removable pin 130 helps retain hanging ammunition on support rails 124A, 124B during rough terrain trundling by the armored vehicle.

Figure 30:
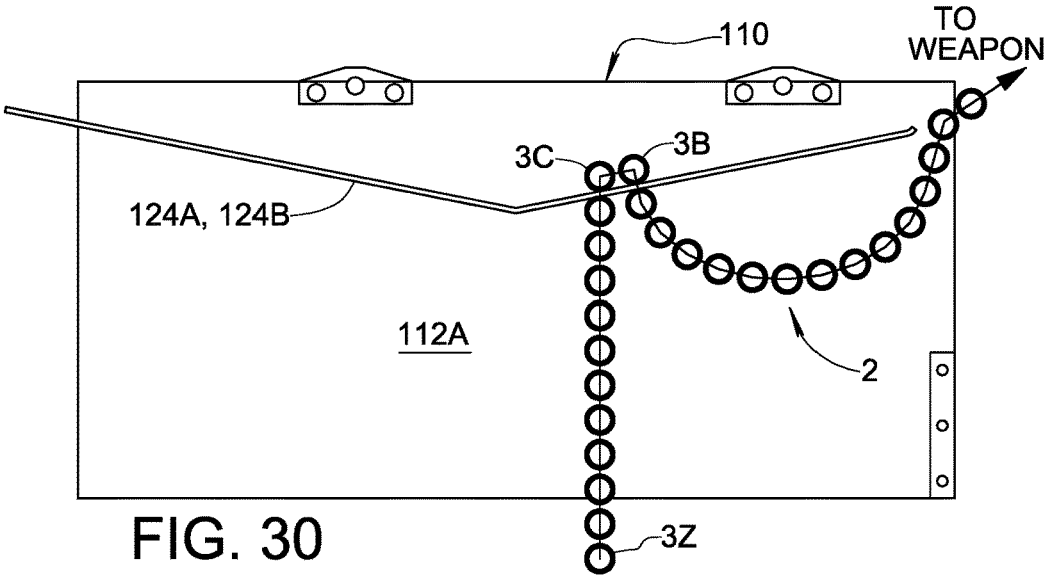
FIG. 30 is a side elevational view of the ammunition storage container shown in FIGS. 26 and 27, wherein the ammunition container is ready for reloading.
Figure 31:
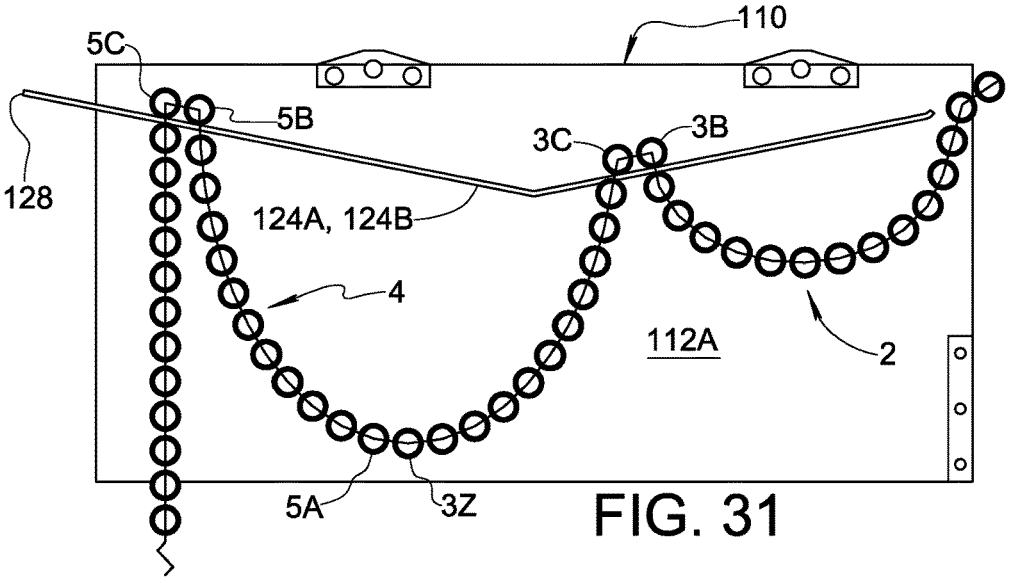
FIG. 31 is a view similar to that of FIG. 30, showing the ammunition container as it is being reloaded with ammunition.
Figure 32:
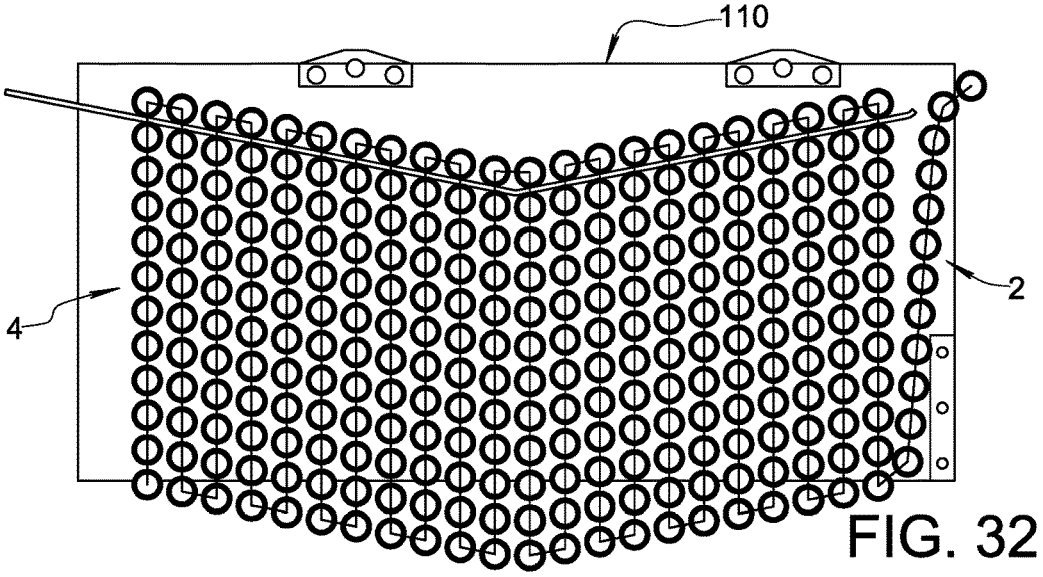
FIG. 32 is a view similar to that of FIG. 30, illustrating the ammunition storage container of FIGS. 26 and 27 after reloading has been completed.

Reloading of ammunition container 110 will now be described with reference to FIGS. 30-32. FIG. 30 shows a condition wherein a remaining portion of a prior ammunition belt 2 is suspended in container 110 prior to reloading. More specifically, a round 3B of prior ammunition belt 2 is supported on rails 124A, 124B, and a next adjacent round 3C is also supported on rails 124A, 124B. A trailing round 3Z of the prior ammunition belt 2, which may be the twelfth round counting from (and including) round 3C, is the final round of prior belt 2. As shown in FIG. 31, a leading round 5A of a new ammunition belt 4 is clipped to trailing round 3Z of prior ammunition belt 2, and a pair of adjacent subsequent rounds 5B, 5C of new belt 4 are then slid over the rear ends 128 of support rails 124A, 124B for support by the rails. The task of hanging the supporting rounds (e.g. rounds 5B and 5C) is facilitated by locating rear ends 128 of support rails 124A, 124B externally beyond the rear edges of side walls 112A, 112B. Round 5B may be the twelfth round counting from (and including) leading round 5A. This process may be repeated until the entire new belt 4 is hung in serpentine fashion from support rails 124A, 124B as shown in FIG. 32. Container 110 may be sized to hold twenty-three columns having twelve rounds in each column. In order to avoid splitting new boxes of ammunition, and to have the benefit of counting in multiples of ten, reloading may be carried out such that twenty columns are loaded having ten rounds in each column. Of course, container 110 may be loaded such that the number of rounds in each column differs from ten or twelve rounds, and the number of rounds may vary from column to column.

It will be appreciated that ammunition containers 10, 40, 70 and 110 are space-efficient, have few moving parts and are therefore reliable, and may be reloaded with ammunition from within an armored vehicle. The ammunition container disclosed herein may be fixedly mounted within a turret compartment and do not need to be dropped down out of the compartment for reloading.

While the invention has been described in connection with exemplary embodiments, the detailed description is not intended to limit the scope of the invention to the particular forms set forth. The invention is intended to cover such alternatives, modifications and equivalents of the described embodiment as may be included within the spirit and scope of the invention.

What is claimed is:

1. An ammunition container for storing a belt of linked ammunition, the ammunition container comprising:

a pair of transversely spaced side walls defining an internal space between the pair of side walls;

at least one bridge member connecting the pair of side walls;

the pair of side walls defining a rear opening and a bottom opening continuous with the rear opening, the rear and bottom openings allowing access to the internal space between the pair of side walls; and a pair of longitudinal support rails respectively mounted to an inner surface of a corresponding one of the pair of side walls, each of the pair of support rails including a front end and a rear end, wherein each of the pair of support rails extends through the rear opening such that the rear end of each support rail is located outside of the internal space.

2. An ammunition container for storing a belt of linked ammunition, the ammunition container comprising:

a pair of transversely spaced side walls defining an internal space between the pair of side walls;

at least one bridge member connecting the pair of side walls;

the pair of side walls defining a rear opening and a bottom opening continuous with the rear opening, the rear and bottom openings allowing access to the internal space between the pair of side walls; and a pair of longitudinal support rails respectively mounted to an inner surface of a corresponding one of the pair of side walls, each of the pair of support rails including a front end and a rear end;

wherein the at least one bridge member includes a front bridge member.

3. An ammunition container for storing a belt of linked ammunition, the ammunition container comprising:

a pair of transversely spaced side walls defining an internal space between the pair of side walls;

at least one bridge member connecting the pair of side walls;

the pair of side walls defining a rear opening and a bottom opening continuous with the rear opening, the rear and bottom openings allowing access to the internal space between the pair of side walls; and a pair of longitudinal support rails respectively mounted to an inner surface of a corresponding one of the pair of side walls, each of the pair of support rails including a front end and a rear end;

wherein the at least one bridge member includes a first top bridge member and a second top bridge member.

4. The ammunition container according to claim 3, wherein each of the first top bridge member and the second top bridge member includes at least one fastener hole for use in mounting the ammunition container to overhead structure.

5. An ammunition container for storing a belt of linked ammunition, the ammunition container comprising:

a pair of transversely spaced side walls defining an internal space between the pair of side walls;

at least one bridge member connecting the pair of side walls;

the pair of side walls defining a rear opening and a bottom opening continuous with the rear opening, the rear and bottom openings allowing access to the internal space between the pair of side walls;

a pair of longitudinal support rails respectively mounted to an inner surface of a corresponding one of the pair of side walls, each of the pair of support rails including a front end and a rear end; and a removable pin extending transversely through aligned holes in the pair of side walls near a top rear corner of the ammunition container.

6. An ammunition container for storing a belt of linked ammunition, the ammunition container comprising:

a pair of transversely spaced side walls defining an internal space between the pair of side walls;

at least one bridge member connecting the pair of side walls;

the pair of side walls defining a rear opening and a bottom opening continuous with the rear opening, the rear and bottom openings allowing access to the internal space between the pair of side walls; and a pair of longitudinal support rails respectively mounted to an inner surface of a corresponding one of the pair of side walls, each of the pair of support rails including a front end and a rear end, wherein one of the pair of support rails has an upwardly facing support surface that is raised relative to an upwardly facing support surface of the other support rail.

* * * * *